US007714744B1

(12) United States Patent
Wichgers

(10) Patent No.: US 7,714,744 B1
(45) Date of Patent: May 11, 2010

(54) SYSTEMS AND METHODS FOR GENERATING ALERT SIGNALS IN AN AIRSPACE AWARENESS AND WARNING SYSTEM

(75) Inventor: Joel M. Wichgers, Urbana, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 286 days.

(21) Appl. No.: 12/069,319

(22) Filed: Feb. 8, 2008

(51) Int. Cl.
*G08B 23/00* (2006.01)

(52) U.S. Cl. ..... 340/965; 340/945; 340/963; 340/966; 340/967; 340/974; 340/975; 701/4; 701/9; 701/14

(58) Field of Classification Search ..... 340/965, 340/945, 963, 966, 967, 974, 975; 342/357.13, 342/27, 28, 65; 701/4, 9, 14
See application file for complete search history.

(56) References Cited

U.S. PATENT DOCUMENTS 5,839,080 A 11/1998 Muller et al.
6,092,009 A 7/2000 Glover
6,112,570 A 9/2000 Muller et al.
6,138,060 A 10/2000 Conner et al.
6,219,592 B1 4/2001 Muller et al.
6,906,641 B2 * 6/2005 Ishihara ..... 340/946
6,980,892 B1 * 12/2005 Chen et al. ..... 701/9
7,098,810 B2 * 8/2006 Bateman et al. ..... 340/963
7,145,501 B1 12/2006 Manfred et al.

OTHER PUBLICATIONS

U.S. Appl. No. 11/904,483, filed Sep. 26, 2007, McCusker.
U.S. Appl. No. 11/904,484, filed Sep. 26, 2007, McCusker.
U.S. Appl. No. 11/904,491, filed Sep. 26, 2007, McCusker et al.
U.S. Appl. No. 11/904,492, filed Sep. 26, 2007, McCusker.

* cited by examiner

*Primary Examiner*—Hung T. Nguyen
(74) *Attorney, Agent, or Firm*—Matthew J. Evans; Daniel M. Barbieri

(57) ABSTRACT

An airspace awareness and warning system ("AAWS") provides input to an airspace alert ("AA") processor from at least one real-time aircraft system or sensor, a navigation system, and an airspace database containing three-dimensional delineations of defined airspace; the processor determines an airspace clearance surface and an aircraft airspace alert surface, and if one surface penetrates the other, the processor generates an alert signal and provides an alert signal to a crew alerting system. The two surfaces are determined by the processor by executing an algorithm(s) embedded in software containing the disclosed embodiments and methods. At least one criterion used to define an aircraft airspace alert surface is programmed to include real-time and/or static input factor data provided by at least one system or sensor input from an aircraft. Such input factor could be used to define an airspace clearance surface.

14 Claims, 18 Drawing Sheets

SYSTEMS AND METHODS FOR GENERATING ALERT SIGNALS IN AN AIRSPACE AWARENESS AND WARNING SYSTEM

BACKGROUND OF THE INVENTION

1. Field of the Invention

This invention pertains to the field of alert signals being provided to the pilot of an aircraft, where such signals are generated by an airspace awareness and warning system.

2. Description of Related Art

Generally, an aviation regulatory authority or organization possesses the authority of designating and defining airspace. In the United States, the Federal Aviation Administration ("FAA") establishes and provides the defined dimensions of airspace. Such airspace could be designated as regulatory and non-regulatory special use airspace, where regulatory special use airspace could include prohibited areas and restricted areas and non-regulatory special use airspace data could include military operations areas, alert areas, warning areas, and national security areas. Prohibited areas contain airspace of defined dimensions identified by an area within which the flight of aircraft is prohibited. Such areas are established for security or other reasons associated with the national welfare. Restricted areas contain airspace within which the flight of aircraft, while not wholly prohibited, is subject to restrictions. Activities within these areas must be confined because of their nature or limitations imposed upon aircraft operations that are not a part of those activities or both. Restricted areas denote the existence of unusual, often invisible, hazards to aircraft such as artillery firing, aerial gunnery, or guided missiles. Penetration of restricted areas without authorization from a using or controlling agency may be extremely hazardous to the aircraft and its occupants.

An airspace is invisible to the pilot but may be identified by a depiction on aeronautical charts or discussed in other publications which provide aeronautical information. The boundaries of an airspace may be delineated by vertical and horizontal limits. The vertical limits of airspace may be designated by altitude floors and ceilings expressed as flight levels or other appropriate measures such as feet or meters above mean sea level (MSL). The horizontal limits of an airspace may be measured and defined by geographic coordinates or other appropriate references that clearly define their perimeter. An airspace may be in effect for one or more designated time periods or run continuously.

The complexity with which an airspace is defined ranges considerably. On one side of the spectrum, the definition of the prohibited airspace of Washington, D.C. is highly complex, irregularly shaped, and defined, in part, by numerous physical landmarks and latitude/longitude points. On the other side of the spectrum, a restricted airspace of Flagstaff, Ariz. is relatively simple, cylindrically-shaped, and defined, in part, by a constant radius extending outward from the center of the airspace which is defined by a latitude/longitude point. In between, the restricted airspaces of Fort Sill, Okla. and Huntsville, Ala. are defined, in part, using four sets of latitude/longitude points. The definitions of each of these exemplary airspaces are presented and discussed below in detail.

Airspaces may present safety of flight issues to the pilot of an aircraft. A safety of flight issue could arise in the instance where a pilot's attention is diverted from flying the aircraft to looking down from the aircraft in an attempt to identify the physical landmarks that demarcate the boundaries of the complex Washington, D.C. airspace. Not only are the boundaries complex but the pilot could lose his or her focus on flying the aircraft and accidentally place the aircraft in an unsafe flight condition. Also, if the aircraft is flying in meteorological conditions that obscure the pilot's ability to see outside of the aircraft, a pilot may unknowingly and unintentionally penetrate such airspace; the same could occur during nighttime flight operations. Invisible hazards to aircraft such as artillery firing, aerial gunnery, or guided missiles may be present, making the penetration of such airspace extremely hazardous to the aircraft and its occupants. Moreover, if a missile defense system is employed to protect the airspace from unauthorized intrusion, a pilot penetrating the airspace could experience tragic consequences should such system be activated and the missiles engage the aircraft.

The embodiments disclosed herein present novel and non-trivial systems and methods which address safety of flight issues related to accidental or inadvertent penetration of defined airspace.

BRIEF SUMMARY OF THE INVENTION

The embodiments disclosed herein present novel and non-trivial systems and methods for generating and providing alerts in an airspace awareness and warning system ("AAWS"). As disclosed herein, an AAWS provides safety and awareness to the pilot of an aircraft by generating one or more alert signals associated with an aircraft operating near defined airspace. As embodied herein, an airspace alert ("AA") processor may define two surfaces based upon criteria selected by a manufacturer or end-user: an aircraft airspace alert surface and airspace clearance surface. Both surfaces could be defined as a function of at least one criterion selectable by the manufacturer or end-user, wherein at least one criterion is programmed to include real-time and/or static input factor data provided by at least one system or sensor input from an aircraft. As embodied herein, an aircraft airspace alert surface and an airspace clearance surface may be determined. If one surface penetrates the other, an AA processor may generate an alert signal commensurate or associated with the severity of the alert and provide such signal to a crew alerting system.

In one embodiment, a system for generating an alert signal in an AAWS is disclosed. The system could be comprised of data sources for providing input factor data comprising at least one real-time and/or static input factor, navigation data, and airspace data, an AA processor, and crew alerting system. The AA processor could receive input factor data, navigation data, and airspace data, define an airspace clearance surface and at least one aircraft airspace alert surface, generate an airspace alert signal if the airspace clearance surface penetrates an aircraft airspace alert surface, and provide an airspace alert signal to a crew alerting system for visual presentation to the pilot by a display unit, aural presentation by an aural unit, and/or tactile presentation by a tactile unit, including any combination thereof.

In another embodiment, a second system for generating an alert signal in an AAWS is disclosed. The system could be comprised of a data source for providing input factor data comprising at least one input factor, a data source of airspace data, an AA processor, and a crew alerting system. The AA processor could receive input factor data, airspace data that is representative of an airspace clearance surface, define at least one aircraft airspace alert surface, generate an airspace alert signal if the airspace clearance surface penetrates an aircraft airspace alert surface, and provide an airspace alert signal to a crew alerting system for visual presentation to the pilot by a display unit, aural presentation by an aural unit, and/or tactile presentation by a tactile unit, including any combination thereof.

In another embodiment, a method for generating an alert signal in an AAWS is disclosed. The method could be comprised of an AA processor receiving input factor data comprising at least one input factor, navigation data, and airspace data, defining an airspace clearance surface and at least one airspace alert surface, generating an airspace alert signal if the airspace clearance surface penetrates an aircraft airspace alert surface, and providing an airspace alert signal to a crew alerting system for visual presentation to the pilot by a display unit, aural presentation by an aural unit, and/or tactile presentation by a tactile unit, including any combination thereof.

In another embodiment, a second method for generating an alert signal in an AAWS is disclosed. The method could be comprised of an AA processor receiving input factor data comprising at least one input factor, navigation data, and airspace data that is representative of an airspace clearance surface, defining at least one airspace alert surface, generating an airspace alert signal if the airspace clearance surface penetrates an aircraft airspace alert surface, and providing an airspace alert signal to a crew alerting system for visual presentation to the pilot by a display unit, aural presentation by an aural unit, and/or tactile presentation by a tactile unit, including any combination thereof.

DETAILED DESCRIPTION OF THE INVENTION

In the following description, several specific details are presented to provide a thorough understanding of embodiments of the invention. One skilled in the relevant art will recognize, however, that the invention can be practiced without one or more of the specific details, or in combination with other components, etc. In other instances, well-known implementations or operations are not shown or described in detail to avoid obscuring aspects of various embodiments of the invention.

Figure 1:
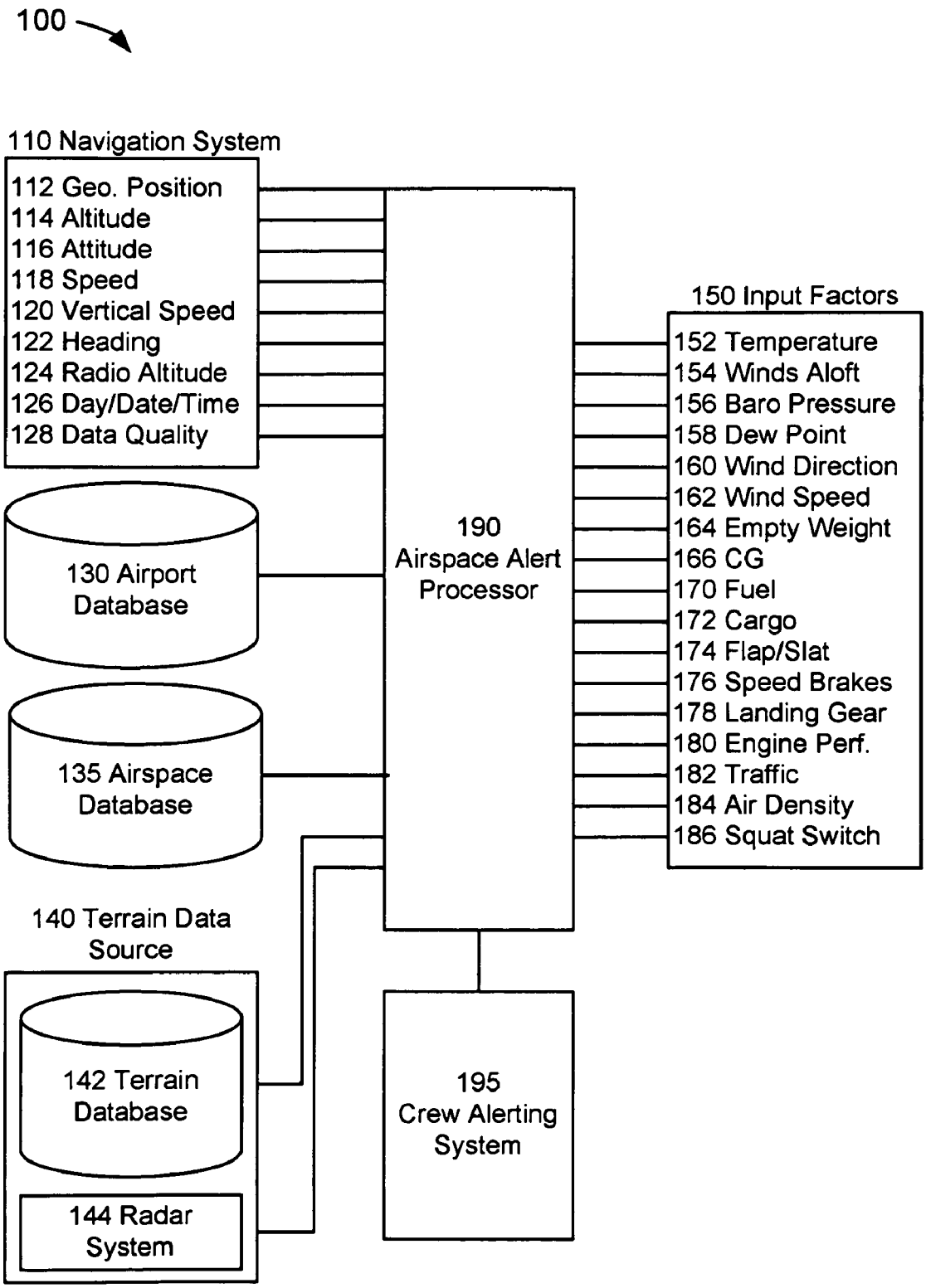
FIG. 1 depicts a block diagram of a system for generating an alert signal in an airspace awareness and warning system.

FIG. 1 depicts an airspace awareness and warning system ("AAWS") 100 suitable for implementation of the techniques described herein. The system may be comprised of a navigation system 110, an airport database 130, an airspace database 135, a terrain data source 140, maneuver profile input factors 150, an airspace alert ("AA") processor 190, and a crew alerting system 195.

A navigation system 110 comprises those systems that provide navigation data information in an aircraft. A navigation system 110 may include, but is not limited to an air/data system, an attitude heading reference system, an inertial guidance system (or inertial reference system), a global navigation satellite system (or satellite navigation system), and a flight management computing system, of all which are known to those skilled in the art. For the purposes of the embodiments herein, a radio altimeter system may be included in the navigation system 110; a radio altimeter system is known to those skilled in the art for determining the altitude above the surface over which the aircraft is currently operating. As embodied herein, a navigation system 110 could provide navigation data including, but not limited to, geographic position 112, attitude 114, speed 118, vertical speed 120, heading 122, radio altitude 124, day/date/time 126, and navigation data quality 128 to an AA processor 190 for subsequent processing as discussed herein. Day/date/time 126 could be data representative of the day, date, or time, or any combination of them, and may be used, for example, for determining whether a defined airspace is in effect. Navigation data quality 128 may include, but are not limited to, accuracy, uncertainty, integrity, and validity for data provided by a navigation system 110. As embodied herein, aircraft position comprises geographic position (e.g., latitude and longitude coordinates) and altitude. Navigation data may be used, in part, to identify a phase of flight of an aircraft and flight attitude, two parameters which may be used to define minimum airspace clearance distance in an airspace awareness and warning system.

An airport database 130 may be used to store airport-related data including, but not limited to, airport and runway information. It should be noted that data contained in any database discussed herein including an airport database 130, an airspace database 135, and a terrain database 142 may be stored in a digital memory storage device or computer-readable media including, but not limited to, RAM, ROM, CD, DVD, hard disk drive, diskette, solid-state memory, PCMCIA or PC Card, secure digital cards, and compact flash cards.

Data contained in such databases could be loaded while an aircraft is on the ground or in flight. Data contained in such databases could be provided manually or automatically through an aircraft system capable of receiving and/or providing such manual or automated data. Data contained in such databases could be temporary in nature; for example, data representative of a temporary runway closure could be stored in an airport database 130, a temporary flight restriction in airspace database 135, and a temporary obstacle in terrain database 142. Any database used in the embodiments disclosed herein may be a stand-alone database or a combination of databases. For example, data stored in an airspace database 135 could be stored in or combined with an airport database 130, a terrain database 142, or with a database used by any other system of the aircraft including, but not limited to, a database associated with a flight management computing system or a terrain awareness and warning system ("TAWS"), including any combination thereof. Examples of TAWS that employ an airport database 130 are provided in U.S. patent application Ser. Nos. 11/904,483; 11/904,491; and 11/904,492.

Airport information could include surveyed location and elevation data, and runway information could include surveyed location and elevation data of the runway and runway threshold. Airport-related data may be used, in part, to identify a phase of flight of an aircraft, a parameter which may be used to define airspace clearances in an airspace awareness and warning system. An example of a database which may provide a source of airport-related data as embodied herein may be a navigation database included as part of a flight management computing system. As embodied herein, an airport database 130 could provide airport-related data to an AA processor 190 for subsequent processing as discussed herein.

An airspace database 135 may be used to store airspace related data including, but not limited to, information related to regulatory special use airspace area and non-regulatory special use airspace area data. Data contained in an airspace database 135 could be provided to an AA processor 190 for determination of a surface representative of airspace and/or for determination of an airspace clearance surface. In one embodiment, data contained in an airspace database 135 could be representative of an airspace surface. In another embodiment, an airspace database 135 may be comprised of one or more databases, where each database could include data representative of one or more airspace clearance surfaces, where each airspace clearance surface could correspond to a specific phase of flight and flight attitude.

Regulatory special use airspace data may be comprised of, in part, prohibited areas and restricted areas. Non-regulatory special use airspace data may be comprised of, in part, military operations areas, alert areas, warning areas, and national security areas. Prohibited areas contain airspace of defined dimensions identified by an area within which the flight of aircraft is prohibited. Such areas may be established for, safety, security, national defense, national welfare, or other reasons. Restricted areas contain airspace within which the flight of aircraft, while not wholly prohibited, is subject to restrictions. Restricted areas may denote the existence of unusual, often invisible, hazards to aircraft such as artillery firing, aerial gunnery, or guided missiles. Penetration of restricted areas without authorization from a using or controlling agency may be extremely hazardous to the aircraft and its occupants.

Airspaces are depicted on aeronautical charts or discussed in other operational publications which provide aeronautical information. An airspace may be delineated by vertical and/or horizontal dimensions. The vertical of airspace may be designated by altitude floors and ceilings expressed as flight levels or other appropriate measures such as feet or meters above mean sea level (MSL) or other reference including the surface of the earth. The horizontal dimensions of an airspace may be defined by geographic coordinates (e.g., latitude ("lat.") and longitude ("long.")) or other appropriate references that clearly define their perimeter. An airspace may be in effect for one or more designated time periods or run continuously.

Generally, an aviation regulatory authority or organization possesses the authority of designating and defining airspace. In the United States, the Federal Aviation Administration ("FAA") establishes and provides the defined dimensions of airspace. For example, FAA Order 7400.8 entitled "Special Use Airspace" provides a listing of regulatory and non-regulatory Special Use Airspace areas, as well as issued but not yet implemented amendments to those areas. FAA Order 7400.9 entitled "Airspace Designations and Reporting Points" provides a listing of terminal and enroute area designations and reporting points, as well as issued but not yet implemented amendments to those areas. At the time of this writing, both Orders may be obtained on the Internet at http://www-.faa.gov/airports_airtraffic/air_traffic/publications. As embodied herein, airspace includes, but is not limited to, any airspace and category of airspace established by an aviation regulatory authority or organization including the airspace and categories of airspace described in FAA Orders 7400.8 and 7400.9. As further embodied herein, an airspace database 135 includes, but is not limited to, data representative of the defined vertical and horizontal limits of any airspace; the time and day or days in which such airspace is in effect could also be included in an airspace database 135.

An airspace database 135 that may be used in AAWS 100 may be an airspace database that is used in conjunction with a terrain awareness and warning system. For example, a TAWS that includes an airspace database is described in a U.S. patent application Ser. No. 12/069,234 filed concurrently with the instant application, entitled "System and Method for Generating Alert Signals in a Terrain Awareness and Warning System," which is incorporated by reference in its entirety.

To demonstrate how an airspace may be defined and the varying levels of complexity of between definitions of airspaces, the prohibited airspace of Washington, D.C. (identified as "P-56") and the restricted airspace of Fort Sill, Okla. (identified as "R-5601E") will be presented as defined in FAA Order 7400.8N. The delineated horizontal limits of P-56 begin at the southwest corner of the Lincoln Memorial (lat. 38° 53'20"North (N.), long. 77° 03'02"West (W.)); thence via a 327° bearing, 0.6 mile, to the intersection of New Hampshire Avenue and Rock Creek and Potomac Parkway, NW (lat. 38° 53'45"N., long. 77° 03'23"W.); thence northeast along New Hampshire Avenue, 0.6 mile, to Washington Circle, at the intersection of New Hampshire Avenue and K Street, NW (lat. 38° 54'08"N., long. 77° 03'01"W.); thence east along K Street, 2.5 miles, to the railroad overpass between First and Second Streets, NE (lat. 38° 54'08"N., long. 77° 00'13"W.); thence southeast via a 158° bearing, 0.7 mile, to the southeast corner of Stanton Square, at the intersection of Massachusetts Avenue and Sixth Street, NE (lat. 38° 53'35"N., long. 76° 59'56"W.); thence southwest via a 211° bearing, 0.8 mile, to the Capitol Power Plant at the intersection of New Jersey Avenue and E Street, SE (lat. 38° 52'59"N., long. 77° 00'24"W.); thence west via a 265° bearing, 0.7 mile, to the intersection of the Southwest Freeway (Interstate Route 95) and Sixth Street, SW extended (lat. 38° 52'56"N., long. 77° 01'12"W.); thence north along Sixth Street, 0.4 mile, to the intersection of Sixth Street and Independence Avenue, SW (lat. 38° 53'15"N., long. 77° 01'12"W.); thence west along the north side of Independence Avenue, 0.8 mile, to the intersection of Independence Avenue and 15th Street, SW (lat. 38° 53'16"N., long. 77° 02'01"W.); thence west along the southern lane of Independence Avenue, 0.4 mile to the west end of the Kutz Memorial Bridge over the Tidal Basin (lat. 38° 53'12"N., long. 77° 02'27"W.); thence west via a 285° bearing, 0.6 mile, to the southwest corner of the Lincoln Memorial, to the point of beginning. P-56 also includes the delineated horizontal limits of that area within a ½-mile-radius from the center of the U.S. Naval Observatory located between Wisconsin and Massachusetts Avenues at 34th Street, NW (lat. 38° 55'17"N., long. 77° 04'01"W.). The designated altitudes of the vertical limits of P-56 range from the surface of the Earth to 18,000 feet MSL (i.e., mean sea level), and the airspace of P-56 is in effect continuously. It should be noted that the upper vertical limit may be referred to as a ceiling altitude, the altitude at which the ceiling of the airspace exists over the perimeter delineated by the horizontal limits.

An advantage of the embodiments herein and the need for an AAWS 100 is demonstrated quite clearly by showing the complexity of which P-56 is defined. Safety of flight issues could arise in the instance where a pilot's attention is diverted from flying the aircraft to looking down from the aircraft in an attempt to identify the physical landmarks that demarcate the boundaries of the complex P-56 airspace. Not only are the boundaries complex but the pilot could lose his or her focus on flying the aircraft and accidentally place the aircraft in an unsafe flight condition. Also, if the aircraft is flying in meteorological conditions that obscure the pilot's ability to see outside of the aircraft, a pilot may unknowingly and unintentionally penetrate such airspace. Moreover, if a missile defense system is employed to protect the airspace of P-56 (or any other designated airspace), a pilot penetrating the airspace could experience tragic consequences should such system be activated and the missiles engage the aircraft.

In comparison to the complex definition of P-56, R-5601E is relatively simple. The delineated horizontal limits of R-5601E are described as follows: Beginning at lat. 34° 38'15"N., long. 98° 37'58"W.; to lat. 34° 36'00"N., long. 98° 46'46"W.; to lat. 34° 38'15"N., long. 98° 48'01"W.; to lat. 34° 38'15"N., long. 98° 45'21"W.; to the point of beginning. The designated altitudes of the vertical limits of R-5601E range from 500 feet AGL (i.e., above ground level) to 6,000 feet MSL, and the airspace of R-5601E is in effect from sunrise to 2200, Monday through Friday; other times by NOTAM, an acronym known to those skilled in the art that means "Notice to Airman"—a system employed by the FAA to disseminate time-critical aeronautical information which is of either a temporary nature or not sufficiently known in advance to permit publication on aeronautical charts or in other operational publications.

Although the definition of the R-5601E airspace is relatively simple, the same safety of flight issues may nonetheless exist. Although not defined by both physical landmarks and longitude/latitude points such as the P-56 airspace, standard navigation maps or charts may depict physical landmarks that could help the pilot identify the boundaries of the R-5601E airspace or other airspace. For example, in an attempt to locate physical landmarks associated with the airspace boundary, the pilot could lose his or her focus on flying the aircraft and accidentally place the aircraft in an unsafe flight condition. Also, if the aircraft is flying in meteorological conditions that obscure the pilot's ability to see outside of the aircraft, a pilot may unknowingly and unintentionally penetrate such airspace. Moreover, invisible hazards to aircraft such as artillery firing, aerial gunnery, or guided missiles may be present, making the penetration of such airspace extremely hazardous to the aircraft and its occupants.

Continuing with FIG. 1, an AAWS 100 could include a terrain data source 140. Examples of terrain data sources are provided in U.S. patent application Ser. No. 12/069,234 filed concurrently with the instant application, entitled "System and Method for Generating Alert Signals in a Terrain Awareness and Warning System," which is incorporated by reference in its entirety. A terrain data source may include, but is not limited to, a terrain database 142, a radar system 144, or both. Terrain data from the terrain data source 140 may include data representative of terrain, obstacles, or both. Obstacles may include, but are not limited to, towers, buildings, poles, wires, other manmade structures, foliage, and aircraft.

A terrain database 142 may be used to store terrain data contained in digital elevation models ("DEM"). Generally, the terrain data of a DEM is stored as grids, and each grid represents an area of terrain. A grid is commonly referred to as a terrain cell. A grid may be of various shapes. For example, a grid may be a cell defined in arc-seconds of latitude and longitude, or a grid may be rectangular, square, hexagonal, or circular. A grid may also be of differing resolutions. For instance, the U.S. Geological Society developed GTOPO30, a global. DEM which may provide 30 arc-seconds (approximately 900 meters) resolution. On the other hand, the Space Shuttle Endeavour in February 2000 acquired elevation data known as Shuttle Radar Topography Mission ("SRTM") terrain elevation data which may provide generally one arc-second (or approximately 30 meters) resolution, providing much greater detail than that provided with GTOPO30 data set. At the present time, resolutions of one-arc second for SRTM terrain data are available for areas over the United States; for all other locations, resolutions of three arc-seconds (approx. 90 meters) are available. In addition to these public sources of terrain data, there are military and private sources of terrain data. Various vendors and designers of avionics equipment have developed databases that have been, for all intents and purposes, proprietary in nature.

Data contained in a terrain data cell may include the value of the highest elevation found within the cell. In an embodiment herein, a terrain database 142 could contain a plurality of terrain cells, each having a value of the highest elevation found within the cell. Data contained in a terrain database 142 could be provided to an AA processor 190 for determination of a surface representative of terrain elevation and/or for the determination of a terrain clearance surface. In one embodiment, data contained in a terrain database 142 could be representative of a terrain surface. In another embodiment, a terrain database 142 may be comprised of one or more databases, where each database could include data representative of one or more terrain clearance surfaces, where each terrain clearance surface could correspond to a specific phase of flight and flight attitude.

A radar system 144 may be employed to develop data representative of the terrain. An example of a radar system 144 used as a basis for a TAWS (or a terrain avoidance system) is described in U.S. patent application Ser. No. 11/904,491 which is incorporated by reference to the extent that it teaches the acquisition of terrain data by a radar system. In a radar system, a transceiver could transmit radio waves into the atmosphere via an antenna which, in turn, produces a focused beam. The transceiver may control the direction of the beam by steering the antenna horizontally and vertically. When the signal strikes or reflects off an object such as terrain or an obstacle, part of the radio wave energy is reflected back and received by the antenna. The range of the object may be determined by the transceiver by measuring the elapsed time between the transmission and reception of the signal. The azimuth of the terrain or obstacle may be determined as the angle to which the antenna was steered in the horizontal direction relative to the longitudinal axis of the aircraft during the transmission/reception of the signal. The elevation or elevation angle of the terrain or obstacle may be determined as the angle to which the antenna was steered in the vertical direction relative to the longitudinal axis of the aircraft during the transmission/reception of the signal. As embodied herein, terrain data and obstacle data acquired by a radar system and data representative of altitude 114 or height could be provided to an AA processor 190 for determination of a surface representative of terrain elevation. In another embodiment, the terrain data provided by a radar system 144 could be used in conjunction with a terrain database 142, an example of which is described in U.S. patent application Ser. No. 11/904,491 which is incorporated by reference to the extent that it teaches such use. In another embodiment; the acquisition of such terrain data could be limited or bounded in the lateral direction (i.e., the direction of the horizontal scan).

Input factors 150 are determining factors which may be used to define, in part, an alert surface, a clearance surface, or both as disclosed below in detail. Input factors 150 are determining factors which may be used as input for at least one criterion used in the definition of an alert surface, a clearance surface, of both. Input factors 150 may be provided by a plurality of aircraft system or component thereof. Input factors 150 may include real-time system or sensor data, signal input from a plurality of aircraft systems or sensors, and information from any data base or source. As embodied herein, an input factor 150 could provide data or a signal of any form containing information that may be provided to and received by an AA processor 190.

As embodied herein, input factors 150 include those inputs defined above as being part of the navigation system 110 (e.g., geographic position 112, attitude 114, speed 118, vertical speed 120, heading 122, radio altitude 124, day/date/time 126, and navigation data quality 128). Moreover, any input provided by a navigation system 110 could be considered an input factor for the purposes of the embodiments herein. In other words, a navigation system 110 may be considered as providing a subset of input factors 150. The presentation of the specific inputs from navigation system 110 should not be construed as an exclusion or limitation to input factors 150. As embodied herein, input factors 150 may include information from any data or information source available to the AA processor 190 including, but not limited to, an airport database 130, an airspace database 135, and a terrain data source 140. In other words, an airport database 130, an airspace database 135, and a terrain data source 140 may be considered as sources providing a subset of input factors 150. The presentation of specific databases should not be construed as an exclusion or limitation to input factors 150.

In an embodiment herein, inputs factors 150 may be selected a manufacturer or end-user as a determining factor for one or more criteria used in an equation which could be employed in the definition of an alert surface. As embodied herein, a maneuver profile could provide the basis of an alert surface including, but not limited to, an aircraft airspace alert surface and an aircraft terrain alert surface. A maneuver profile may be defined by an equation containing one or more selected criteria, each of which may comprise one or more input factors 150.

In another embodiment herein, inputs factors 150 may be selected a manufacturer or end-user as a determining factor for one or more criteria used in an equation which could be employed in the definition of a clearance surface. As embodied herein, a clearance distance could provide the basis of a clearance surface including, but not limited to, an airspace clearance surface and a terrain clearance surface. Additionally, a clearance distance could be applied to an aircraft airspace alert surface and an aircraft terrain alert surface. A clearance distance may be defined by an equation containing one or more selected criteria, each of which may comprise one or more input factors 150.

When included in an equation, data representative of input factors 150 may be acquired by or through aircraft systems and sensors as discussed above and be provided as input to an AA processor 190. When received, the AA processor 190 may process the data in accordance with an avoidance maneuver algorithm that contains the equation or equations defining a maneuver profile and an airspace clearance distance. As a result, the AA processor 190 may determine a unique alert surface, clearance surface, or both based upon the application of the real-time dynamic or static input factors 150.

One or more maneuver profiles may be defined using one or more selected criteria, each of which may be dependent on one or more input factors 150. The application of such criteria and input factors 150 by an AA processor 190 may determine an alert surface that represents real-time predictable and achievable aircraft performance using input factors 150. Although a manufacturer or end-user may define a maneuver profile using one criterion such as a constant climb gradient (as will be discussed below in detail) that may be independent of input factors 150, the advantages and benefits of the embodiments herein exploit the ability of an AA processor 190 to receive a plurality of available input factors 150, apply them to a maneuver profile defined and contained in an algorithm, and determine an alert surface unique to actual conditions of flight operations as measured by the values of the input factors 150. The advantages and embodiments disclosed herein apply equally to the formation of a clearance surface.

To provide a simple example of how input factors 150 may be used in the embodiments herein, suppose a maneuver profile is defined with criteria comprising an aircraft's maximum rate of climb or angle of climb over a given horizontal distance. Those skilled in the art understand that this climb performance may be affected by a plurality of factors including, but not limited to, altitude, attitude, temperature, aircraft speed, and winds aloft. Here, determining factors representing altitude 114, attitude 116, speed 118, temperature 152, and winds aloft 154 may be provided as input factors 150 to AA processor 190 for subsequent processing in accordance with the criteria that defines the maneuver profile. Because altitude 114 and temperature 152 could affect climb performance, speed 118 could affect any maneuver designed for transition to best rate of climb or angle of climb speed, and winds aloft 154 and speed 118 could affect the horizontal distance over which the climb performance may be achieved, an AA processor 190 is able to define and project a unique alert surface in front of the aircraft that is real-time because it is based upon input factors 150. As will be discussed below in detail, if an alert surface is penetrated by an airspace clearance surface (which the AA processor 190 has defined based upon, in part or in whole, data provided by an airspace database 135), then the processor may generate an alert signal and provide such signal to a crew alerting system 195.

In the following paragraphs, other examples of criteria and performance factors are provided to illustrate the ability with which a manufacturer or end-user may define a maneuver profile as embodied herein. These illustrations are intended to provide exemplary criteria and performance factors that may be used in an AAWS 100, and are not intended to provide a limitation to the embodiments discussed herein in any way, shape, or form.

In one example, a maneuver profile could include meteorological or environmental criteria including, but not limited to, air density 184 and winds aloft 154 factors, where air density 184 may determined by such factors as altitude 114, temperature 152, barometric pressure 156, and dew point 158, and winds aloft 154 may determined by such factors as wind direction 160 and wind speed 162. As noted above, input factors 150 may include some of those inputs provided to an AA processor 190 by a navigation system 110, even though they are not enumerated under item 150 of FIG. 1; input factors that could affect the performance of the aircraft may include some inputs that are provided by any aircraft system other than a navigation system 110. As embodied herein, one or more input factors 150 could be included in the computation of another input factor. For instance, winds aloft 154 could have been considered in a computation of speed 118, and barometric pressure 156 could have been considered in a computation of altitude 114. In such instances, an AA processor 190 may be programmed to accept only one of these factors.

In another example, a maneuver profile could include criteria related to determination of day and night. If so, input factors could include, but are not limited to, geographic position 112 and day/date/time 126. In another example, a maneuver profile could include weight and balance criteria. If so, input factors 150 could include, but are not limited to, data representative of aircraft empty weight 164, center of gravity ("CG") 166, weight of fuel 168, and weight of cargo 170. In another example, a maneuver profile could include aircraft configuration and system criteria. If so, input factors 150 could include, but are not limited to, data representative of an aircraft's flap and slat 174, speed brake 176, and landing gear 178 configurations. In another example, a maneuver profile could include engine performance criteria. If so, input factors 150 could include, but are not limited to, data representative of engine performance or status 180 or available thrust. In another example, a maneuver profile could include traffic information criteria associated with systems such as, but not limited to, Automatic Dependent Surveillance-Broadcast (ADS-B), Automatic Dependent Surveillance-Rebroadcast (ADS-R), Traffic Information Services-Broadcast (TIS-B), Aircraft Collision Avoidance System (ACAS), or other sensors such as radar, forward looking infrared (FLIR), and camera. If so, input factors 150 could include, but are not limited to, data representative of traffic location, direction of flight, and speed 182.

In another example, a maneuver profile could include criteria related to phase of flight and flight attitude which are discussed below in detail. In another example, a maneuver profile could include criteria related to a specific maneuver or flight profile. If so, input factors could include, but are not limited to, data representative of a standardized arrival and departure procedure, an instrument approach procedure, a missed approach procedure, and a special operational approach procedure such as an RNP approach, each of which could be provided to an AA processor 190 from data provided by a navigation system 110. In another example, a maneuver profile could include criteria related to the type of threat which could be encountered by the aircraft. If so, input factors could include, but are not limited to, data representative of airspace, terrain, and obstacles, each of which could be provided to an AA processor 190 from data provided by an airspace database 135 and/or a terrain data source 140.

In another example, a maneuver profile could include criteria related to limiting the vertical or the horizontal distances of the profile. If so, input factors 150 could include, but are not limited to, data representative of the absolute ceiling of the aircraft (which may be provided as a constant which could be a constant offset by other criteria discussed above which could affect aircraft climb performance), distance to an airport of intended landing, or speed 118 which could be derived by an AA processor 190 from data provided by a navigation system 110 and airport database 130.

An AA processor 190 may be any electronic data processing unit which executes software or source code stored, permanently or temporarily, in a digital memory storage device or computer-readable media (not depicted herein) including, but not limited to, RAM, ROM, CD, DVD, hard disk drive, diskette, solid-state memory, PCMCIA or PC Card, secure digital cards, and compact flash cards. An AA processor 190 may be driven by the execution of software or source code containing algorithms developed for the specific functions embodied herein. Common examples of electronic data processing units are microprocessors, Digital Signal Processors (DSPs), Programmable Logic Devices (PLDs), Programmable Gate Arrays (PGAs), and signal generators; however, for the embodiments herein, the term processor is not limited to such processing units and its meaning is not intended to be construed narrowly. For instance, a processor could also consist of more than one electronic data processing units. As embodied herein, an AA processor 190 could be a processor (s) used by or in conjunction with any other system of the aircraft including, but not limited to, a processor(s) associated with a flight management computing system, an aircraft collision avoidance system, a TAWS, or any combination thereof.

An AA processor 190 may receive input data from various systems including, but not limited to, navigation system 110, an airport database 130, an airspace database 135, a terrain data source 140, and maneuver profile input factors 150. An AA processor 190 may be electronically coupled to a navigation system 110, an airport database 130, an airspace database 135, a terrain data source 140, and maneuver profile input factors 150 to facilitate the receipt of input data. It is not necessary that a direct connection be made; instead, such receipt of input data could be provided through a data bus or through a wireless network.

A crew alerting system 195 includes those systems that provide, in part, aural, visual, and/or tactile stimulus presented to attract attention and convey information regarding system status or condition. A crew alerting system 195 may include, but is not limited to, an aural alert unit for producing aural alerts, a display unit for producing visual alerts, and a tactile unit for producing tactile alerts. Aural alerts may be discrete sounds, tones, or verbal statements used to annunciate a condition, situation, or event. Visual alerts may be information that is projected or displayed on a cockpit display unit to present a condition, situation, or event to the pilot. Tactile alerts may be any tactile stimulus to present a condition, situation, or event to the pilot. In addition, alerts may be based on conditions requiring immediate crew awareness or attention. Caution alerts may be alerts requiring immediate crew awareness in which subsequent corrective action will normally be necessary. Warning alerts may be alerts for detecting terrain threat that requires immediate crew action. Both caution and warning alerts may be presented as aural alerts, visual alerts, tactile alerts, or in any combination thereof. When presented visually, one or more colors may be presented on a display unit indicating one or more levels of alerts. For instance, amber or yellow may indicate a caution alert and red may indicate a warning alert.

In one embodiment, an aural alert could call out "caution, airspace" when the conditions for a caution alert have been met or "warning, airspace" when the conditions for a warning alert have been met. In another embodiment, a visual message could display "caution, airspace" text when the conditions for a caution alert have been met or "warning, airspace" text when the conditions for a warning alert have been met. In another embodiment, a text message could be displayed in color, e.g., the "caution, airspace" text could be displayed in amber and the "warning, airspace" could be displayed in red. In another embodiment, the terrain that is causing the alert could be indicated visually, aurally, and/or tactilely, in any combination. In another embodiment, the aural and visual alerts could be presented simultaneously. In another embodiment, the alert could be issued along with one or more recommendations and/or guidance information for responding to the alert condition including, for example, the audio and/or visual indication of "Warning, airspace. Pull-up and turn left."

The advantages and benefits of the embodiments discussed herein may be illustrated by showing examples of using maneuver profiles and alert surfaces in an airspace awareness and warning system. The drawings of FIGS. 2 and 3 provide two exemplary airspaces to illustrate vertical or perimeter surface(s) and ceiling of an airspace as described by delineated horizontal limits and designated altitudes. For the purpose of illustration only, the surface of the Earth is shown as flat in the drawings of FIGS. 2 and 3.

Figure 2A:
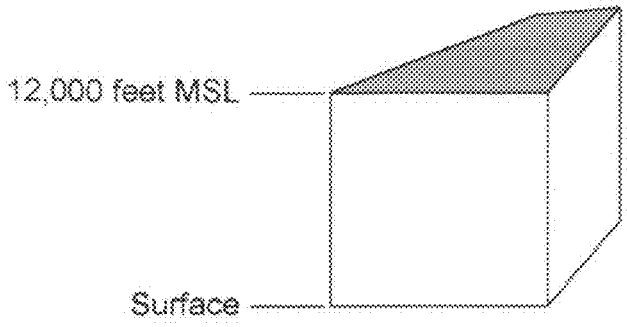
FIG. 2 provides exemplary depictions of a first airspace to illustrate vertical or perimeter surface(s) and ceiling of an airspace as described by delineated horizontal limits and designated altitudes.
Figure 3:
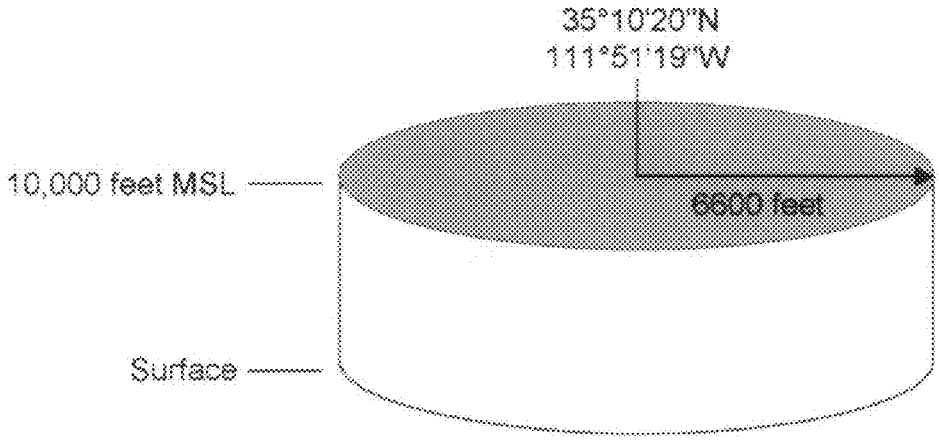
FIG. 3 provides an exemplary depiction of a second airspace to illustrate vertical or perimeter surface(s) and ceiling of an airspace as described by delineated horizontal limits and designated altitudes.

FIG. 2A provides an exemplary three-dimensional depiction of restricted airspace in the vicinity of Huntsville, Ala. (identified as "R-2104C"). The designated altitudes of the vertical limits of R-2104C range from the surface of the Earth to 12,000 feet MSL. The vertical faces of the airspace represent perimeter surfaces of the airspace, and the horizontal face (shown as the shaded surface) represents the ceiling. Although the "floor" of the airspace is not depicted, it is represented by the surface of the Earth bounded by the horizontal delineations.

Figure 2B:
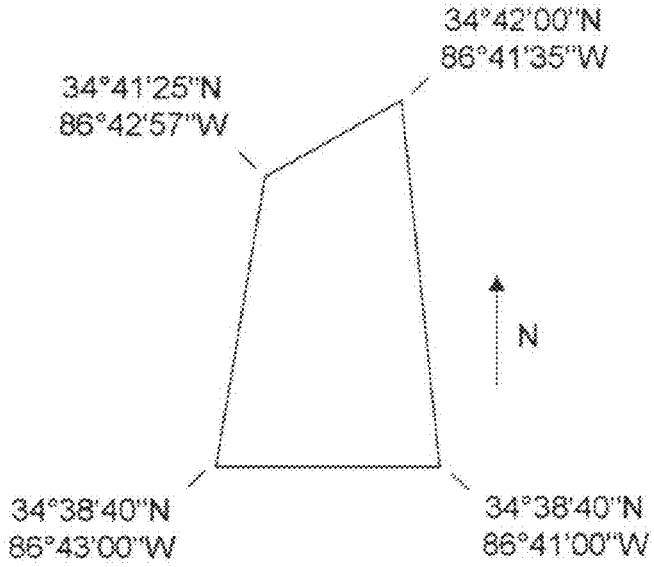

FIG. 2B provides an exemplary depiction of the perimeter or horizontal boundary of R-2104C as viewed from the top. The delineated horizontal limits of R-2104C are described with the following latitude and longitude coordinates: Beginning at lat. 34° 41'25"N., long. 86° 42'57"W.; to lat. 34° 42'00"N., long. 86° 41'35"W.; to lat. 34° 38'40"N., long. 86° 41'00"W.; to lat. 34° 38'40"N., long. 86° 43'00"W.; to the point of beginning. The airspace of R-2104C is in effect from 0600 to 2000 local time, Monday through Saturday; other times by NOTAM 6 hours in advance; NOTAM is an acronym known to those skilled in the art that means "Notice to Airman"—a system employed by the FAA to disseminate time-critical aeronautical information which is of either a temporary nature or not sufficiently known in advance to permit publication on aeronautical charts or in other operational publications.

FIG. 3 provides an exemplary three-dimensional depiction of restricted airspace in the vicinity of Flagstaff, Ariz. (identified as "R-2302"). The delineated horizontal limits of R-2302 consist of a circular area with a 6,600 foot radius centered at lat. 35° 10'20"N, long. 111° 51'19'W. The designated altitudes of the vertical limits of R-2302 range from the surface of the Earth to 10,000 feet MSL, and the boundary is in effect from 0800 to 2400 Mountain Standard Time (MST), Monday through Saturday. The cylindrical vertical face of the airspace represents perimeter surface of the airspace, and the horizontal face (shown as the shaded surface) represents the ceiling. Although the floor or the airspace is not depicted, it is represented by the surface of the Earth bounded by the horizontal delineations.

Although the surface of the Earth provides the floor of the illustrative airspaces depicted in the drawings of FIGS. 2 and 3, the floor of an airspace may not be defined down to the surface of the Earth. For example, the floor of the R-5601E airspace discussed above is 500 feet above ground level (AGL).

Figure 4A:
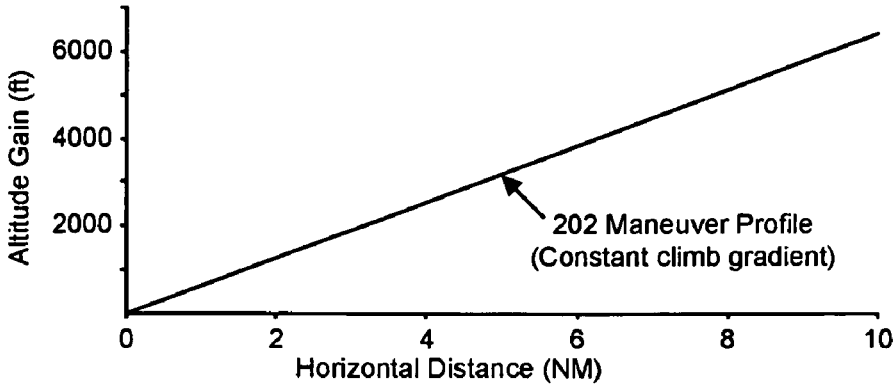
FIG. 4 provides exemplary depictions of vertical airspace maneuver profiles and alert surfaces of an aircraft in level flight.
Figure 4B:
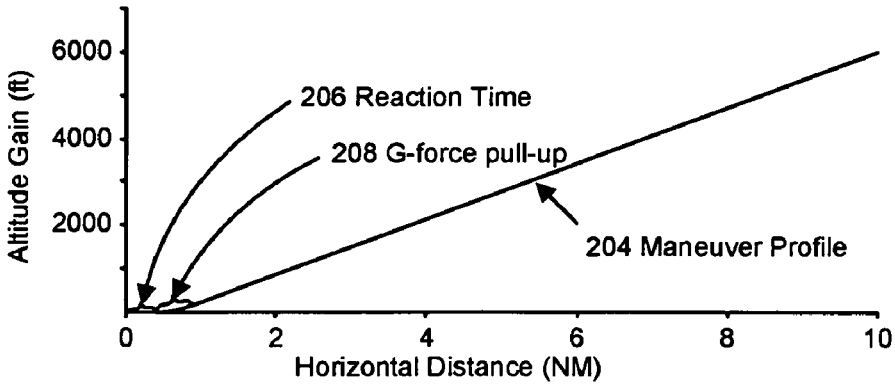
Figure 4C:
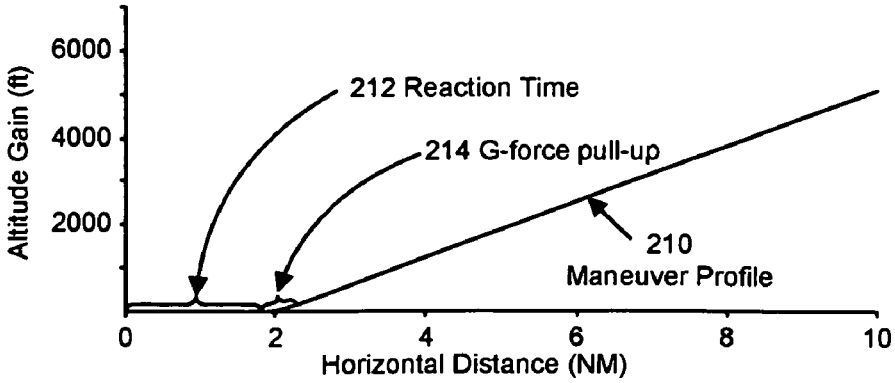

The drawings of FIGS. 4A through 4C provide exemplary maneuver profiles which may serve as the basis for establishing alert surfaces. The drawings provide an example of a maneuver profile in a vertical direction that may used for airspace avoidance.

FIG. 4A provides an illustration of a simple maneuver profile. Item 202 illustrates a maneuver profile defined as a constant climb gradient such as 6 degrees. When viewed in isolation, maneuver profile 202 is a simple profile comprising a single criterion independent of any input factor including altitude 114. Without an input factor, a maneuver profile 202 could be the same as alerting surface.

In FIGS. 4B and 4C, maneuver profile 202 has been redefined by incorporating two criteria into each profile: pilot reaction time and a G-Force pull-up maneuver. As shown in FIGS. 4B and 4C, the maneuver profiles will shift to the right to accommodate a horizontal distance contributed by the addition of the two criteria. Because the magnitude of the distance of each criterion may be dependent on at least one input factor 150 such as speed 118, such factor could be provided as an input to the AA processor 190 for the computation and definition of an alert surface.

In FIG. 4B, maneuver profile 204 includes a pilot reaction time 206 of 3 seconds and a G-force pull-up maneuver 208 of 0.25 g, where g is the value of the acceleration of gravity which is nominally approximately 32.2 feet per second squared ($ft/s^2$) on earth. In FIG. 4C, maneuver profile 210 includes a pilot reaction time 212 of 13 seconds and a G-force pull-up maneuver 214 of 0.25 g. As embodied herein, the inclusion of criteria such as pilot reaction time and G-force pull-up maneuver in maneuver profiles 204 and 210 could be selected by a manufacturer or an end-user. It should be noted that the values 3 and 13 seconds, 0.25 g, and 10 nautical miles (NM) have been selected for the sole purpose of illustration and do not establish a limit to the embodiments herein.

Figure 4D:
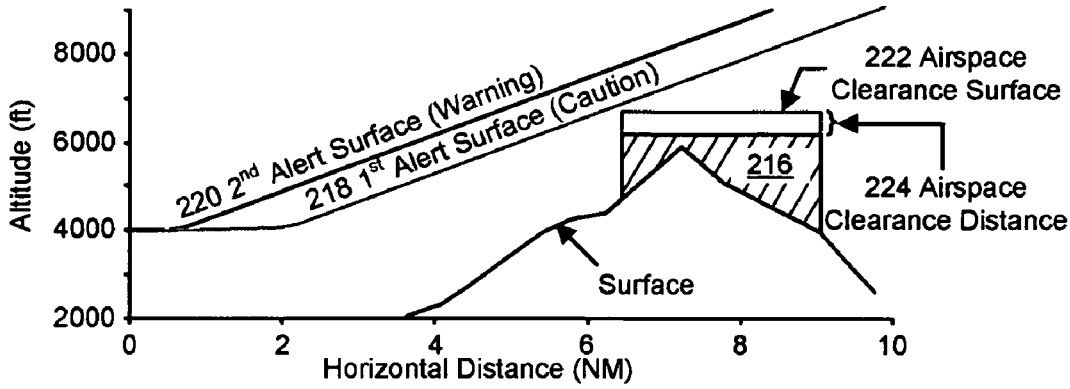
Figure 4E:
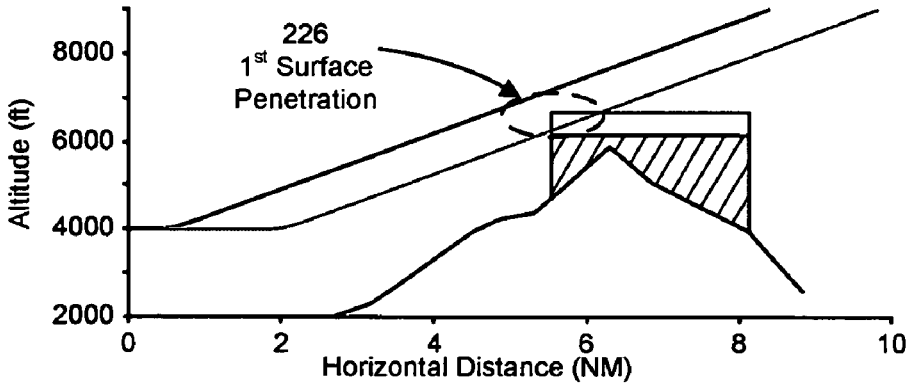
Figure 4F:
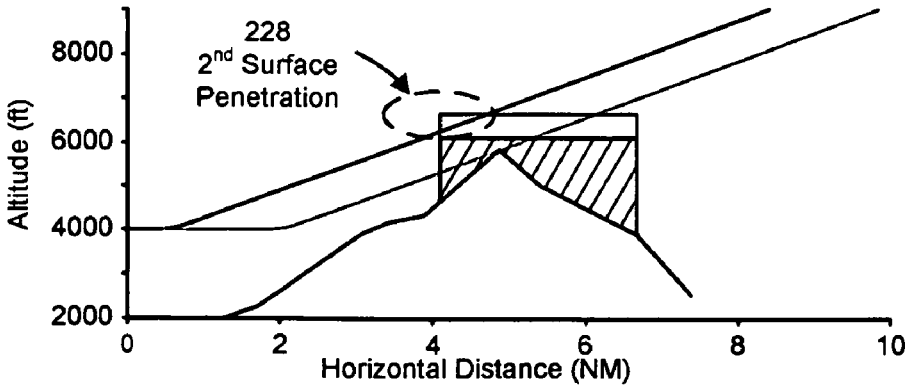

FIGS. 4D through 4F provide exemplary projections of two alerting surfaces of an aircraft operating at 4,000 feet in level flight and 500 knots which could be represented by such input factors as altitude 114, attitude 116, and speed 118. As shown, the aircraft is approaching an airspace 216 (shown with diagonal hash marks) of higher altitude along its projected flight path. As embodied herein, only one alerting surface may be sufficient for a generation of an alert signal by an AA processor 190 and for the receiving of such signal by a crew alerting system 195. A first alert surface 218 is based upon maneuver profile 210, and a second alert surface 220 is based upon maneuver profile 204. As shown in FIG. 4D, a first alert surface 218 could be associated with a caution-type alert, and as discussed above, a caution alert may require immediate crew awareness and subsequent corrective action. Likewise, a second alert surface 220 could be associated with a warning-type alert, and as discussed above, a warning alert may require immediate crew awareness and immediate crew action.

Airspace 216 of FIGS. 4D through 4F comprises of a surface representative of the vertical or perimeter surface(s) and ceiling corresponding to the surface(s) and ceiling data that could be provided by an airspace database 135. FIGS. 4D through 4F provide an exemplary depiction of an airspace clearance surface 222 that may be projected vertically above airspace 216 at an airspace clearance distance 224 to provide vertical separation. Although not depicted, an airspace clearance surface could also be projected horizontally at a clearance distance to provide horizontal separation. Additionally, an airspace clearance surface could be projected vertically below an airspace where the floor of such airspace is sufficiently above the surface of the Earth to permit aircraft operations below it.

As embodied herein, an airspace clearance distance 224 is optional and does not have to be employed. If not employed, an airspace clearance surface 222 could be considered the same as the airspace surface 216 or coinciding with the airspace surface 216, and receipt of airspace data could constitute the receipt of data representative of an airspace clearance surface 222. For example, a manufacturer or end-user could rely only on a maneuver profile(s) profiles that define an alert surface(s) to provide clearance. In another example, an airspace database 135 may include data representative of one or more airspace clearance surfaces, and the data provided could be based upon at least one input factor data 150. In such an example, data representative of airspace clearance surface(s) could be stored in an airspace database 135 corresponding to specific phases of flight, flight attitudes, or both as discussed below.

If employed, however, the value of an airspace clearance distance 224 may not remain constant between take-off and landing. Instead, the value of an airspace clearance distance 224 could depend on a plurality of operational criteria or other criteria. For example, an airspace clearance distance may be determined by input factors 150 used to determine the following criteria: phase of flight (e.g., terminal, approach, departure, and enroute), flight attitudes (e.g., level, descending, or climbing flight), or both. Input factors provided for these criteria could include geographic position 112, altitude 114, attitude 116, speed 118, vertical speed 120, and input from an airport database 130. Examples of differing clearance distances and a possible dependency based upon different phases of flight and flight attitudes for terrain avoidance are illustrated with the minimum performance standards of a TAWS published by the FAA in TSO-C151b.

A terminal phase of flight could exist when the aircraft position is a pre-defined distance (e.g., 15 nautical miles) or less from the nearest runway while the range to the nearest runway threshold is decreasing and the aircraft is operating at or below (lower than) an upper terminal phase boundary altitude, where the value of the upper terminal phase boundary altitude varies as a function of height above runway and distance to the runway, which could be determined by the AA processor 190 based upon navigation system 110 data and airport database 130. Generally, the terminal phase of flight ends where the approach phase begins.

An approach phase of flight could exist when the aircraft is a pre-defined distance (e.g., 5 nautical miles) or less to the nearest runway threshold, the height above the nearest runway threshold location and elevation is equal to or less than a pre-defined altitude (e.g., 1,900 feet), and distance to the nearest runway threshold is decreasing.

A departure phase of flight could exist if an aircraft is on the ground upon initial power-up. A reliable parameter or a combination of parameters may be used to determine whether or not the aircraft is on the ground. For example, one parameter which could initially determine the aircraft to be on the ground could be a signal generated by a weight-on-wheels switch 186 ("squat switch") to indicate whether or not the aircraft is on the ground. Another parameter could be the radio altitude 124. Other parameters such as speed 118, altitude 116, geometric position 112, and information contained in an airport database 130, airspace database 135, and/or a terrain data source 140 could be used to determine if the aircraft is on the ground or airborne. For example, an aircraft could be "on the ground" if it is operating at a speed less than 35 knots and altitude within +/−75 feet of field elevation or nearest runway elevation. Similarly, an aircraft could be "airborne" if it is operating at a speed greater than 50 knots and altitude 100 feet greater than field elevation; in this example, it can be reliably determine that the aircraft is operating in the departure phase of flight. Other parameters which may be considered are climb state, and distance from departure runway. Once the aircraft reaches a pre-defined altitude (e.g., 1,500 feet above the departure runway), the departure phase could end.

An enroute phase of flight may exist anytime the aircraft is more than a pre-defined distance (e.g., 15 nautical miles) from the nearest airport or whenever the conditions for terminal, approach and departure phases of flight are not met.

As embodied herein, the value of an airspace clearance distance 224 may depend on a phase of flight and flight attitude. For example, if an aircraft is operating in the enroute phase of flight, a vertical airspace clearance distance 224 could be 700 feet when operating in a level flight attitude and 500 feet when operating in a descending flight attitude. In another example, if an aircraft is operating in the terminal phase of flight, a vertical airspace clearance distance 224 could be 350 feet when operating in a level flight attitude and 300 feet when operating in a descending flight attitude. In another example, if an aircraft is operating in the approach phase of flight, a vertical airspace clearance distance 224 could be 150 feet when operating in a level flight attitude and 100 feet when operating in a descending flight attitude. The value of an airspace clearance distance 224 may depend on the phase of flight and not flight attitude. For example, if an aircraft is operating in the departure phase of flight, an airspace clearance distance 224 could be set to one value (e.g., 100 feet) irrespective of flight attitude. It should also be noted that level flight attitude may or may not include aircraft operating at relatively low vertical speeds and the values may differ across the phases of flight. For example, an aircraft climbing or descending at a rate of 500 per minute or less may be considered as operating in level flight in one phase of flight but not in another.

The above embodiments and discussion with respect to phases of flight and values of airspace clearance distances 224 are illustrations intended solely to provide examples and are in no way intended to be limited to those discussed and presented herein. As embodied herein, an AA processor 190 may determine phase of flight, flight attitude, and airspace clearance distance data using algorithms programmed in executable software code. Those skilled in the art will appreciate the ability and ease with which executable software code may be reprogrammed or modified to facilitate subsequent or concurrent performance standards without affecting or expanding the scope of the embodiments discussed herein.

A manufacturer or end-user may select one or more alternative criteria. For example, an aircraft with poor climb performance may use different criteria in defining an airspace clearance surface, and input factors 150 associated with climb performance could be provided such as weight and balance criteria as discussed above. In another example, a reduced airspace clearance may be needed to accommodate user-specific operations. For instance, a specific maneuver or flight profile such as a precision approach that is coupled to an autoflight system (and not hand flown) may allow an aircraft to fly closer to an airspace rather than a hand-flown, step-down approach; as such, criteria including inputs factors 150 of data representative of the precision approach or status of the autoflight system could be determining factors of an airspace clearance distance. In another example, helicopter operations could provide special operations that necessitate one or more criteria in determining an airspace clearance distance. As embodied herein, aircraft includes any vehicle capable of controlled-flight.

In another example, a maneuver profile could include criteria related to determination of day and night as discussed above. In another example, an airspace clearance distance 224 could include meteorological or environmental criteria and associated input factors 150 as discussed above. In another example, an airspace clearance distance could include aircraft configuration and system criteria and associated input factors 150 as discussed above. In another example, an airspace clearance distance 224 could include aircraft configuration and system criteria and associated input factors 150 as discussed above. In another example, an airspace clearance distance 224 could include engine performance criteria and associated input factors 150 as discussed above. In another example, an airspace clearance distance 224 could include engine performance criteria and associated input factors 150 as discussed above. In another example, an airspace clearance distance 224 could include traffic information criteria associated with systems and associated input factors 150 as discussed above. In another example, an airspace clearance distance 224 could include airspace criteria and associated input factors 150 as discussed above. As an operational example of AAWS 100, when taking off from runway number 1 at Ronald Reagan Washington National Airport, an aircraft is required under one departure procedure (at the time of this writing) to make a left turn as soon as possible after taking off from Runway 1 so as to avoid P-56 (previously described), which is located approximately 1.5 nautical miles north of the airport. Should the left turn not be executed because, for example, the flight crew was distracted by an engine failure on take off, the AAWS 100 may provide an alert signal to the crew alerting system 195 such that the crew or auto-flight system could maneuver the aircraft within the achievable performance capabilities of the aircraft to avoid entering airspace P-56. The AA processor 190 could determine the achievable performance capabilities of the aircraft taking into account input factors 150 that may include, but are not limited to, aircraft geometric position 112, altitude 114, attitude 116, speed 118, temperature 152, barometric pressure 156, wind direction 160, wind speed 162, aircraft empty weight 164, CG 166, weight of fuel 170, weight of cargo 172, flap/slat 174, and engine performance 180.

In the preceding paragraphs, the examples of criteria and performance factors are provided to illustrate the ability with which a manufacturer or end-user may define an airspace clearance distance 224 as embodied herein. These illustrations are intended to provide exemplary criteria and performance factors that may be used in an airspace awareness warning system 100, and are not intended to provide a limitation to the embodiments discussed herein in any way, shape, or form.

FIGS. 4E and 4F provide exemplary depictions of events in which an airspace clearance surface 222 penetrates two alert surfaces as the aircraft approaches airspace 216, where each event triggers an alert that may be provided to the pilot by a crew alerting system 195. In an embodiment of FIG. 4E, a first surface penetration 226 has occurred where the airspace clearance surface 222 has penetrated a first alert surface 218 as the aircraft approaches airspace 216. Because the first alert surface 218 is associated with a caution alert in this example as discussed above, an AA processor 190 could generate a caution alert signal and provide such signal to a crew alerting system 195 as a result of the penetration. As the aircraft continues to approach airspace 216 as shown in FIG. 4F, a second surface penetration 228 has occurred where the airspace clearance surface 222 has penetrated a second alert surface 220. Because the second alert surface 220 is associated with a warning signal as discussed above, an AA processor 190 could generate a warning signal and provide such signal to the crew alerting system 195 as a result of the penetration.

As discussed above, a first alert surface 218 and a second alert surface 220 have been based upon maneuver profiles 210 and 204, respectively, where each has been based on maneuver profile 202 of a constant angle climb (e.g., six degrees) having a distance of 10 NM. As embodied herein and discussed above, however, the advantages of the embodiments herein may incorporate any profile which may be used or defined as a maneuver profile. A manufacturer or end-user of an AAWS 100 could establish or configure a plurality of maneuver profiles; on the other hand, a manufacturer or end-user of the aircraft may wish to provide a single maneuver profile under all conditions to simplify pilot training. As embodied herein, a maneuver profile may comprise of one or more vertical maneuvers, one or more horizontal maneuvers as discussed below in detail, or it may be a combination of one or more vertical and horizontal maneuvers.

The drawings of FIG. 5 provide top-down exemplary depictions of search volumes within which potentially hazardous airspace such as, for example, that airspace shown in FIGS. 4E through 4F that penetrated the alert surfaces 226 and 228, the triggering events that cause an AA processor 190 to generate and provide an alert signal to a crew alerting system 195 to alert the pilot. A search volume could be defined by a manufacturer or end-user and may include horizontal limits, vertical limits, or both, and may be applied in terrain avoidance applications as discussed below in detail. A few examples of such volumes include, but are not limited to, those depicted in FIGS. 5A through 5K. A search volume could comprise lateral limits (identified as "LL1" and "LL2") along a projected flight path (identified as "P"), a back limit (identified as "BL"), and a forward limit (identified as "FL") as shown in FIGS. 5A through 5K. These illustrations are intended to provide limits that may be used in an AAWS 100, and are not intended to provide a limitation to the embodiments discussed herein in any way, shape, or form. Moreover, these illustrations could apply equally for terrain avoidance as discussed below in detail.

Figure 5A:
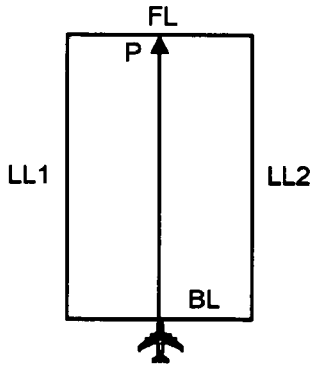
FIG. 5 provides top-down exemplary depictions of search volumes along projected flight paths.
Figure 5C:
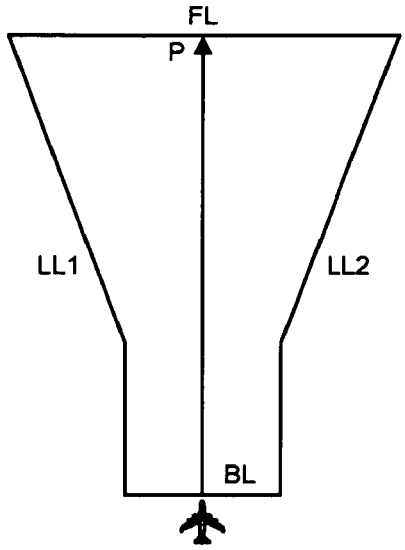
Figure 5B:
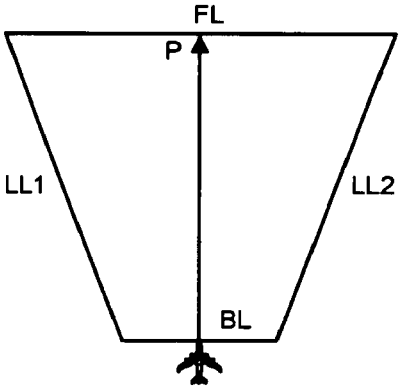
Figure 5E:
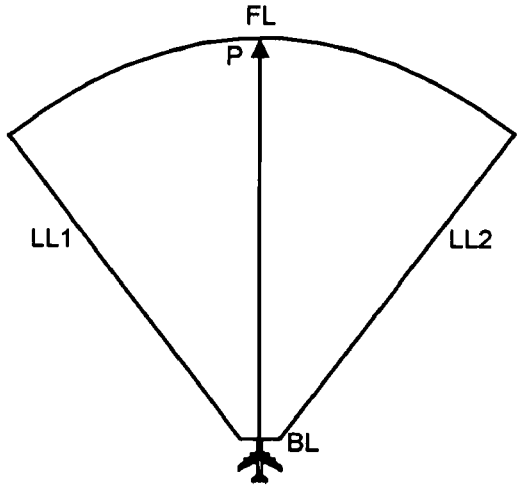
Figure 5D:
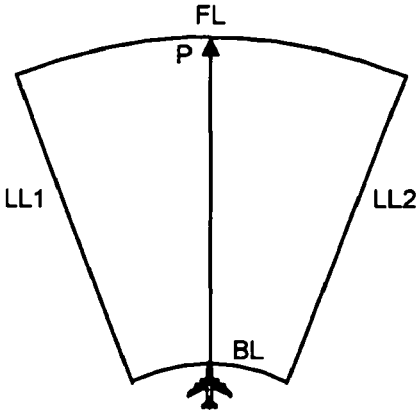
Figure 5F:
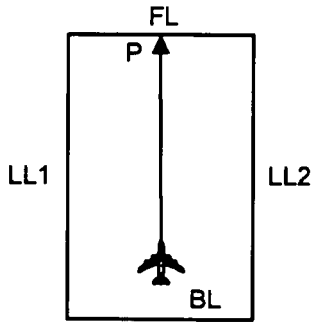
Figure 5G:
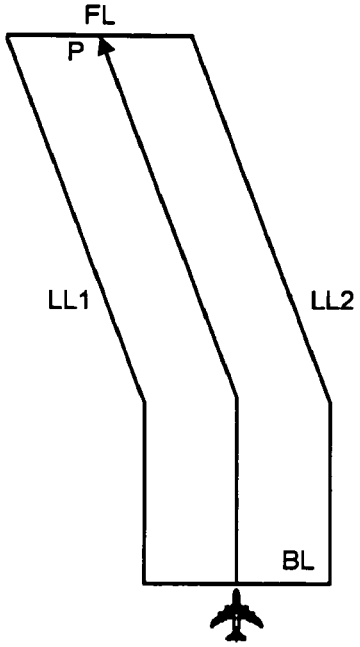
Figure 5H:
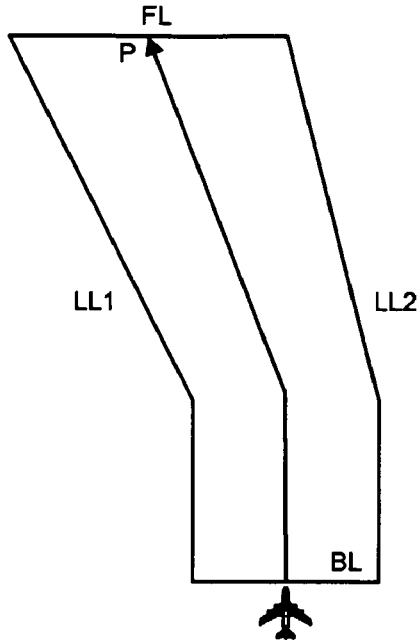
Figure 5I:
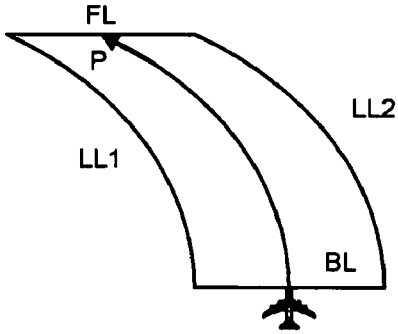
Figure 5J:
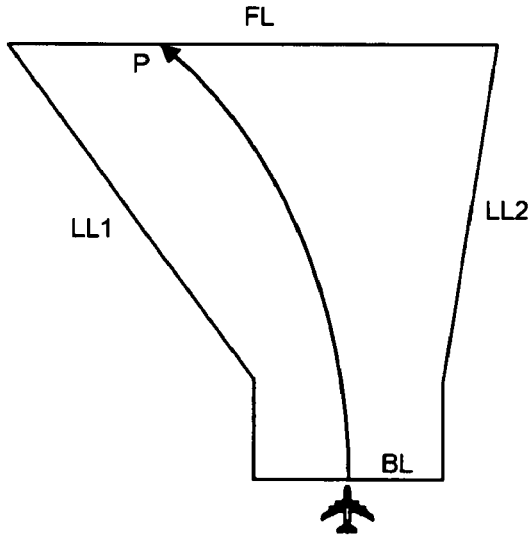
Figure 5K:
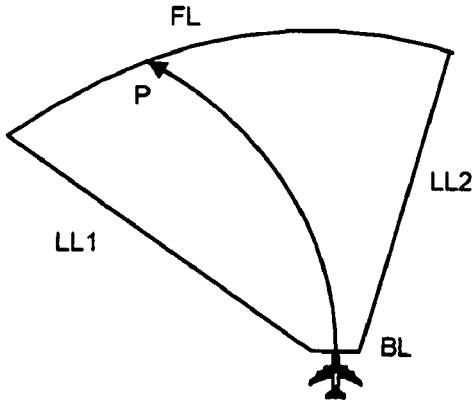

Lateral, forward, and back limits could be made a function of one or more of the same criteria and one or more input factors of a maneuver profile as discussed above. Forward and back limits may vary between lateral limits as shown in FIGS. 5A through 5C. In another example, a forward limit may remain constant by forming an arc between the lateral limits as shown in FIGS. 5D and 5E. In another example, the back limit may be established behind the aircraft position received from a navigation system 110 to accommodate uncertainty in the aircraft position as indicated by navigation data quality 128, and/or uncertainty in the airspace database 135 or terrain data source information 140 as shown in FIG. 5F. In another example, the back limit may be established in front of the aircraft current position. In another example, the lateral limits may be altered to accommodate a change in direction of a projected flight path as shown in FIGS. 5G and 5H. In another example, the lateral limits may be dynamic to accommodate turning flight; for instance, FIG. 5A could take the shape of FIG. 51, FIG. 5C could take the form of FIG. 5J, and FIG. 5E could take the form of FIG. 5K during turning flight. Vertical limits of a search volume may include that airspace which is at or above an airspace clearing surface such as the airspace clearance surface 222 depicted in FIGS. 5D through 5F.

Figure 6A:
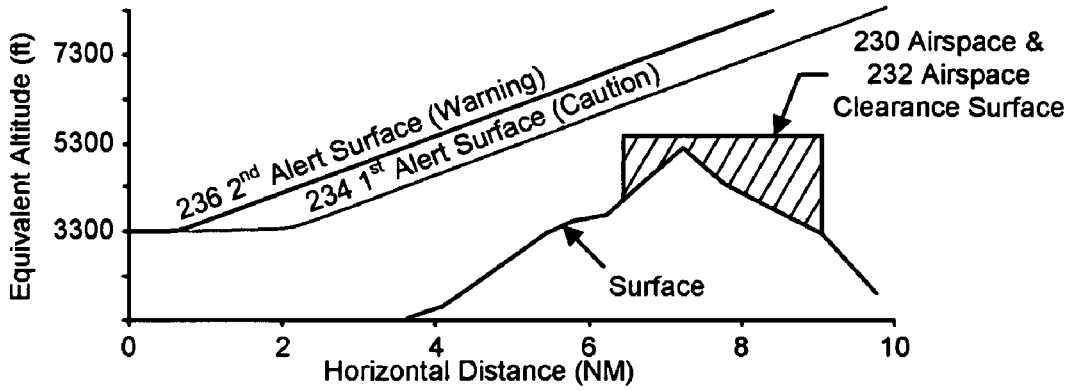
FIG. 6 provides exemplary depictions of vertical airspace maneuver profiles and alert surfaces of an aircraft in level flight where the airspace and airspace clearance surfaces coincide.
Figure 6B:
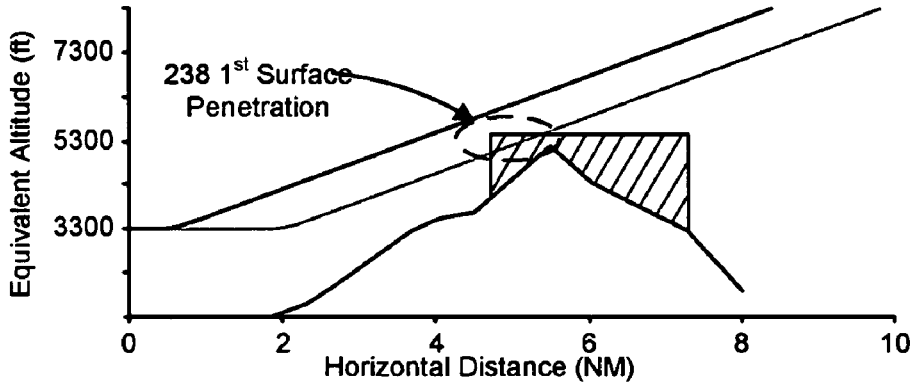
Figure 6C:
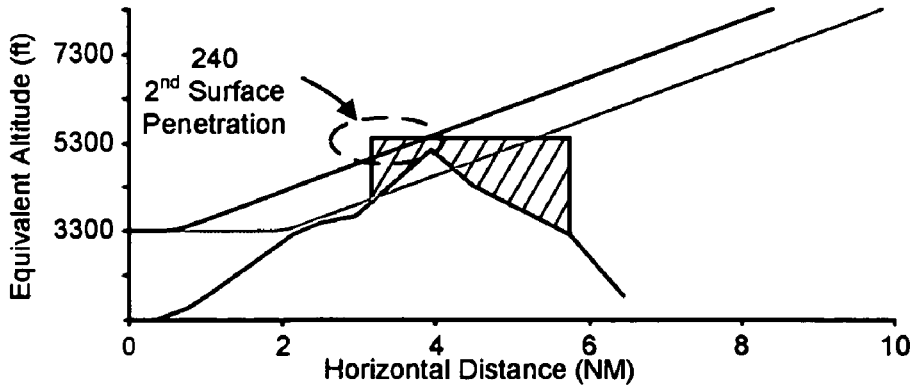

FIGS. 6A through 6C provide exemplary projections of two alert surfaces based upon the two maneuver profiles 204 and 210 of FIGS. 4B and 4C. In the embodiments of FIGS. 6A through 6C, airspace 230 and airspace clearance surface 232 coincide as depicted in FIG. 6A, which is an advantage of this embodiment because an airspace clearance distance 224 (e.g., FIG. 4D) may be omitted from the computation of an airspace clearance surface. In those embodiments where airspace and airspace clearance surface coincide, these terms may be used interchangeably. One exemplary manner to take advantage of this embodiment is to project each alert surface to an equivalent altitude that is offset by the value of the vertical airspace clearance distance 224 while the alert surface remains based upon an input factor altitude 114. As previously stated, an aircraft operating in level flight in the enroute phase of flight may have an airspace clearance distance 224 of 700 feet. Because an airspace vertical clearance distance 224 is also the value of the offset, the alert surfaces may be projected from the aircraft altitude of 4,000 feet down to an equivalent altitude of 3,300 feet for this exemplary 700 feet vertical airspace clearance distance 224 as shown in FIGS. 6A through 6C.

FIGS. 6B and 6C provide exemplary depictions of events in which an airspace clearance surface 232 penetrates two alert surfaces as the aircraft approaches airspace 230, where each event triggers an alert that may be provided to the pilot by a crew alerting system 195. In an embodiment of FIG. 6B, a first surface penetration 238 has occurred where the airspace clearance surface 232 has penetrated a first alert surface 234 as the aircraft approaches airspace 230. Because the first alert surface 234 is associated with a caution alert in this example as discussed above, an AA processor 190 could generate a caution alert signal and provide such signal to a crew alerting system 195 as a result of the penetration. As the aircraft continues to approach airspace 230 as shown in FIG. 6C, a second surface penetration 240 has occurred where the airspace clearance surface 232 has penetrated a second alert surface 236. Because the second alert surface 236 is associated with a warning signal as discussed above, an AA processor 190 could generate a warning signal and provide such signal to the crew alerting system 195 as a result of the penetration. It should be noted that the embodiments of FIGS. 6A through 6C may be applied for any alert surface and is not limited to the alert surfaces, phase of flight, or flight attitude depicted therein.

Figure 7A:
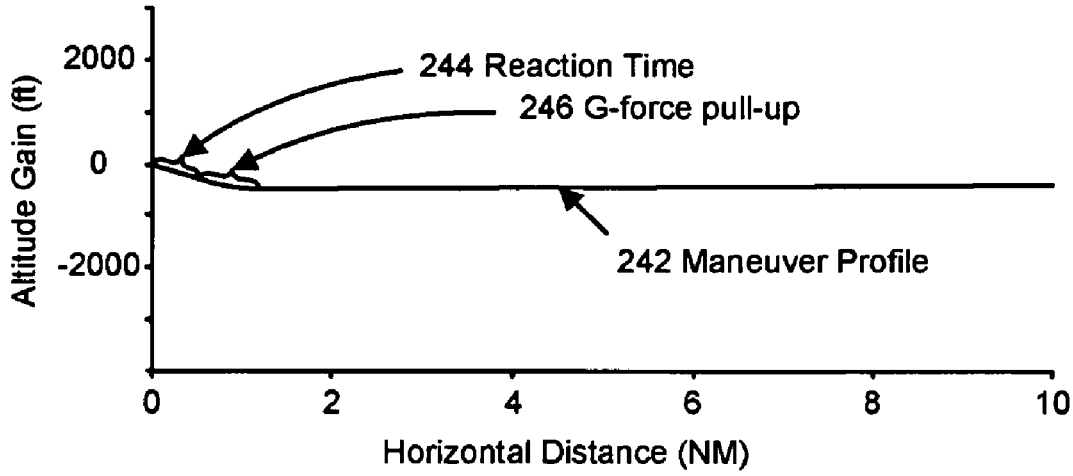
FIG. 7 provides exemplary depictions of vertical airspace maneuver profiles and alert surfaces of an aircraft in descending flight.
Figure 7B:
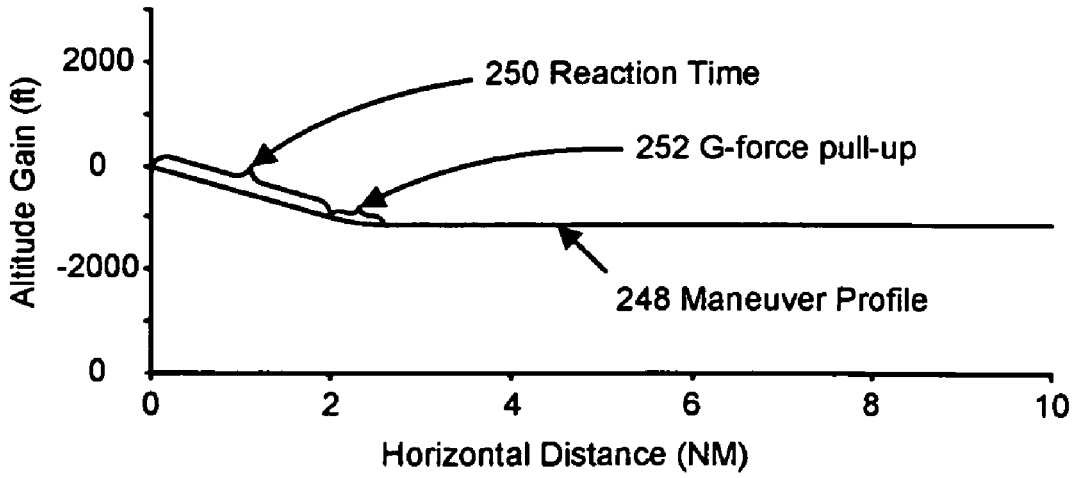

FIGS. 7A and 7B provide exemplary maneuver profiles which may serve as the basis for establishing alert surfaces. In FIGS. 7A and 7B, maneuver profiles 242 and 248 have been defined by incorporating two criteria into each profile: pilot reaction time and a G-Force pull-up maneuver. Additional criteria could include attitude 116 and vertical speed 120, or a phase of flight and flight attitude parameter based upon aircraft-related data provided by an airport database 130 and attitude 116. As these additional criteria demonstrate and as embodied herein, input factors 150 could comprise of alternative sources or a combination of other input factors for any profile of which a manufacturer or end-user may define. As shown in FIGS. 7A and 7B, the maneuver profiles have shifted to the right to accommodate a horizontal distance contributed by the addition of the two criteria. Because the magnitude of the distance of each criterion may be dependent on at least one input factor such as speed 118, such factor could be provided as an input to the AA processor 190 for the computation and definition of an alert surface.

Maneuver profile 242 of FIG. 7A includes a pilot reaction time 244 of 3 seconds and a G-force pull-up maneuver 246 of 0.25 g. Maneuver profile 248 of FIG. 7B includes a pilot reaction time 250 of 13 seconds and a G-force pull-up maneuver 252 of 0.25 g. It should be noted that the values of 3 and 13 seconds for the pilot reaction times 244 and 250, 0.25 g for the G-force pull-up maneuvers 246 and 252, and 10 NM for horizontal distance have been selected for the sole purpose of illustration and do not establish a limit to the embodiments herein.

Figure 7C:
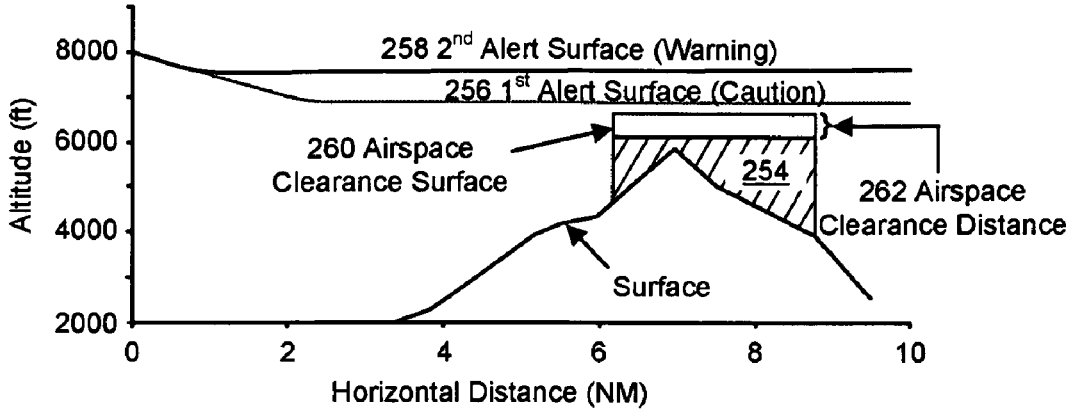
Figure 7D:
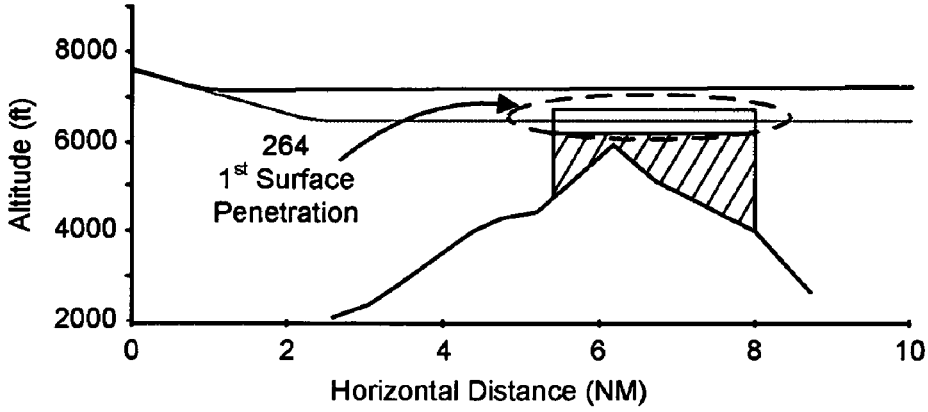
Figure 7E:
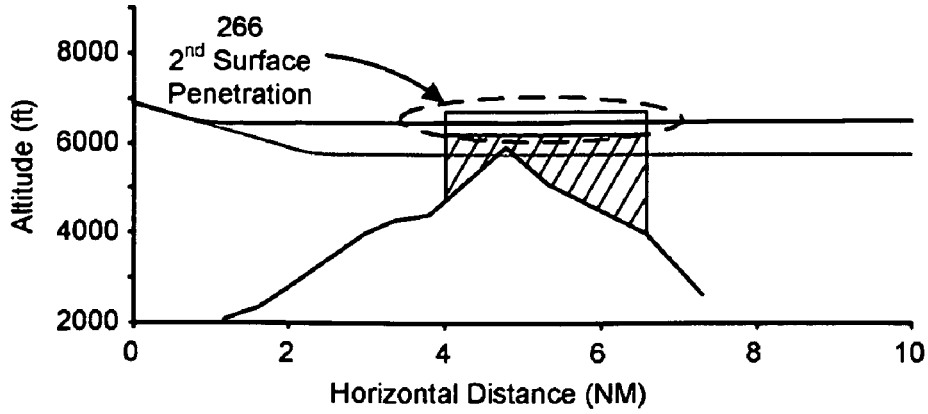

FIGS. 7C through 7E provide exemplary projections of two alerting surfaces of an aircraft descending through 6,000 feet which could be represented by input factors such as attitude 116 and altitude 114. As shown, the aircraft is approaching an airspace 254 along its projected flight path. A first alert surface 256 is based upon maneuver profile 248, and a second alert surface 258 is based upon maneuver profile 242. As shown in FIG. 7C, a first alert surface 256 could be associated with a caution-type alert, and a second alert surface 258 could be associated with a warning-type alert.

FIGS. 7C through 7E depict of an airspace clearance surface 260 that may be projected above airspace 254 at an airspace clearance distance 262. FIGS. 7D and 7E provide exemplary depictions of events in which an airspace clearance surface 260 penetrates two alert surfaces as the aircraft approaches airspace 254, where each event triggers an alert being that may be provided to the pilot by a crew alerting system 195. In an embodiment of FIG. 7D, a first surface penetration 264 has occurred where the airspace clearance surface 260 has penetrated a first alert surface 256 as the aircraft approaches airspace 254. Because the first alert surface 256 is associated with a caution alert in this example as discussed above, an AA processor 190 could generate a caution alert signal and provide such signal to a crew alerting system 195 as a result of the penetration. As the aircraft continues to approach airspace 254 as shown in FIG. 7E, a second surface penetration 266 has occurred where the airspace clearance surface 260 has penetrated a second alert surface 258. Because the second alert surface 258 is associated with a warning signal as discussed above, the processor 190 could generate a warning signal and provide such signal to the crew alerting system 195 as a result of the penetration. Although not shown, an airspace clearance surface 260 could have been projected horizontally at the same or a different clearance distance to provide horizontal separation as discussed above.

Figure 8A:
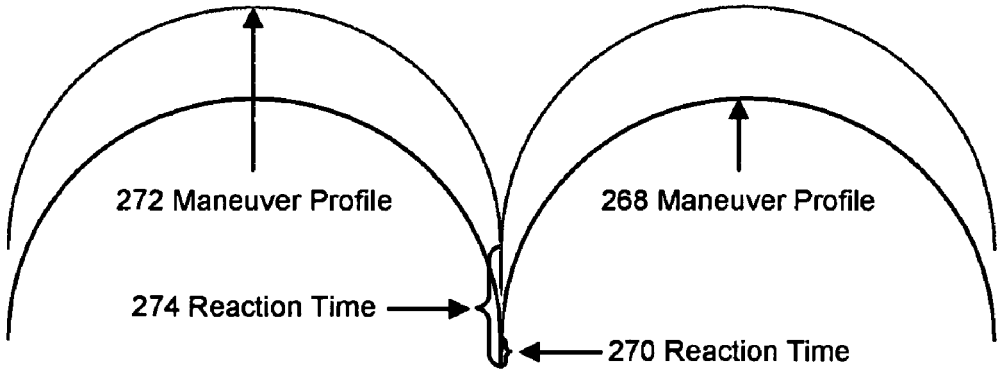
FIG. 8 provides exemplary depictions of horizontal airspace alert surfaces of an aircraft in flight.

FIG. 8A provides exemplary maneuver profiles which may serve as the basis for establishing alert surfaces. In FIG. 8A, maneuver profiles 268 and 272 have been defined by incorporating two criteria into each profile: a constant radius turn and pilot reaction time. As shown in FIG. 8A, the maneuver profiles have shifted forward to accommodate a horizontal distance contributed by the addition of the two criteria. Because the magnitude of the distance of the criteria may be dependent on at least two input factors such as attitude 116 and speed 118, such factors could be provided as input factors to the AA processor 190 for the computation and definition of an alert surface.

Maneuver profile 268 includes a pilot reaction time 270 of 3 seconds, and maneuver profile 272 includes a pilot reaction time 274 of 13 seconds. In an embodiment, the inclusion of a pilot reaction time and the exclusion of a G-force pull-up maneuver, for instance, could be selected by a manufacturer or an end-user of an airspace awareness and avoidance system 100. It should be noted that the values of 3 and 13 seconds for the pilot reaction times 270 and 274 have been selected for the sole purpose of illustration and do not establish a limit to the embodiments herein.

Figure 8B:
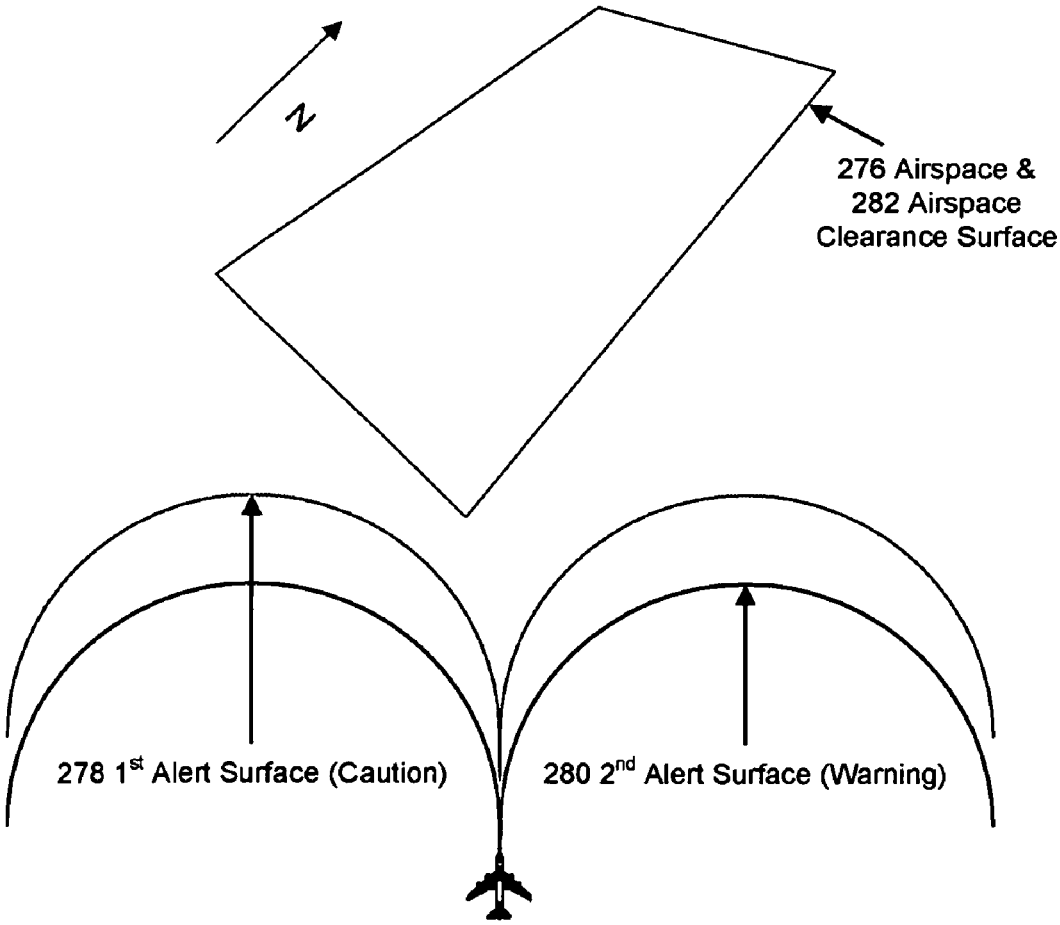
Figure 8C:
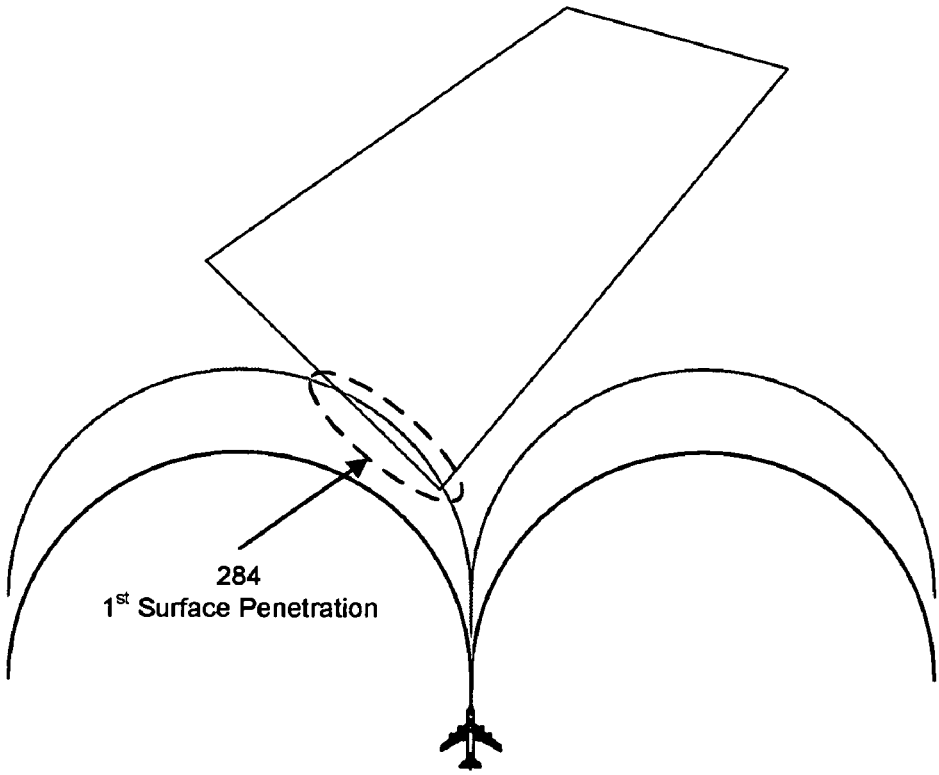
Figure 8D:
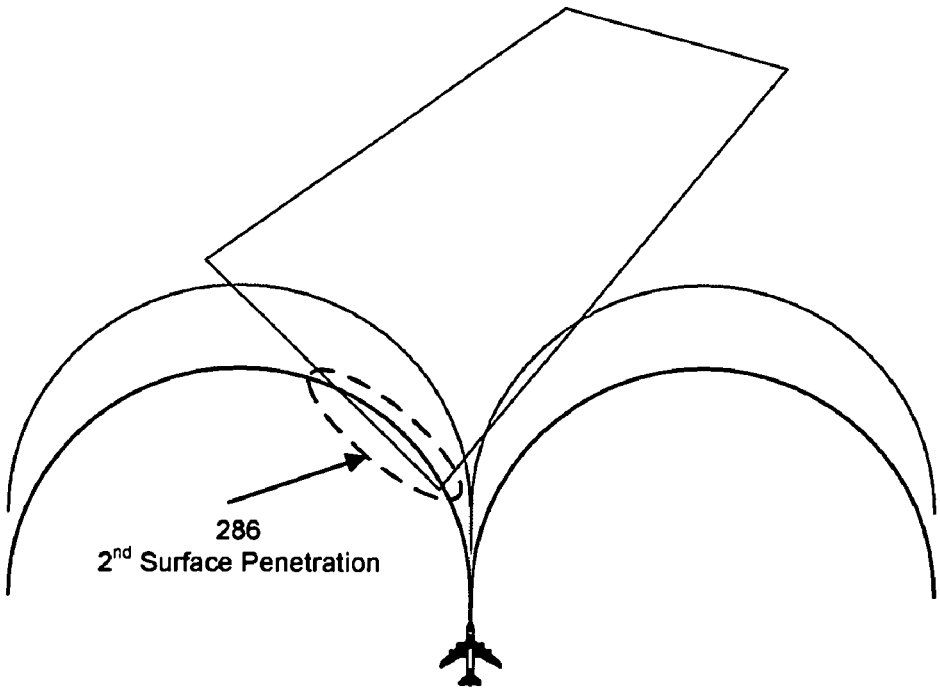

FIGS. 8B through 8D provide an exemplary depiction of an aircraft having two alerting surfaces based upon maneuver profiles 268 and 272 and approaching airspace 276 (which is the same airspace that is as shown in FIG. 2B) along its projected flight path. A first alert surface 278 is based upon maneuver profile 272, and a second alert surface 280 is based upon maneuver profile 268. As shown in FIG. 8B, a first alert surface 278 could be associated with a caution-type alert, and a second alert surface 280 could be associated with a warning-type alert.

FIGS. 8B through 8D depict an airspace clearance surface 282 that may be projected above airspace 276 at an airspace clearance distance (e.g., items 224 and 262). When viewed from above, the airspace clearance surface 282 coincides with airspace 276. Although not shown, an airspace clearance surface 282 could have been projected horizontally at the same or a different clearance distance to provide horizontal separation as discussed above. FIGS. 8C and 8D provide exemplary depictions of events in which an airspace clearance surface 282 penetrates two alert surfaces as the aircraft approaches airspace 276, where each event triggers an alert that may be provided to the pilot by a crew alerting system 195. In an embodiment of FIG. 8C, a first surface penetration 284 has occurred where the airspace clearance surface 282 has penetrated a first alert surface 278 as the aircraft approaches airspace 276. Because the first alert surface 278 is associated with a caution alert in this example as discussed above, an AA processor 190 could generate a caution alert signal and provide such signal to a crew alerting system 195 as a result of the penetration. As the aircraft continues to approach airspace 276 as shown in FIG. 8D, a second surface penetration 286 has occurred where the airspace clearance surface 282 has penetrated a second alert surface 280. Because the second alert surface 280 is associated with a warning signal as discussed above, the processor 190 could generate a warning signal and provide such signal to the crew alerting system 195 as a result of the penetration.

It should be noted that the penetration of the first alert surface 278 occurred on the left side of the aircraft before it occurred on the right side. Such an occasion—penetration to one side and not the other—could provide a basis used in an AAWS for providing lateral guidance.

It should be noted that the discussion thus far has focused on separate vertical and horizontal profiles. Although the discussion has focused separately on maneuver profiles projected vertically and horizontally, an additional embodiment herein could provide a three-dimensional maneuver profile that may combine or incorporate both horizontal and vertical profiles, either in part or in whole. Because an alerting surface may be based upon a maneuver profile, a three-dimensional alerting surface may be based upon a three-dimensional maneuver profile.

Figure 9A:
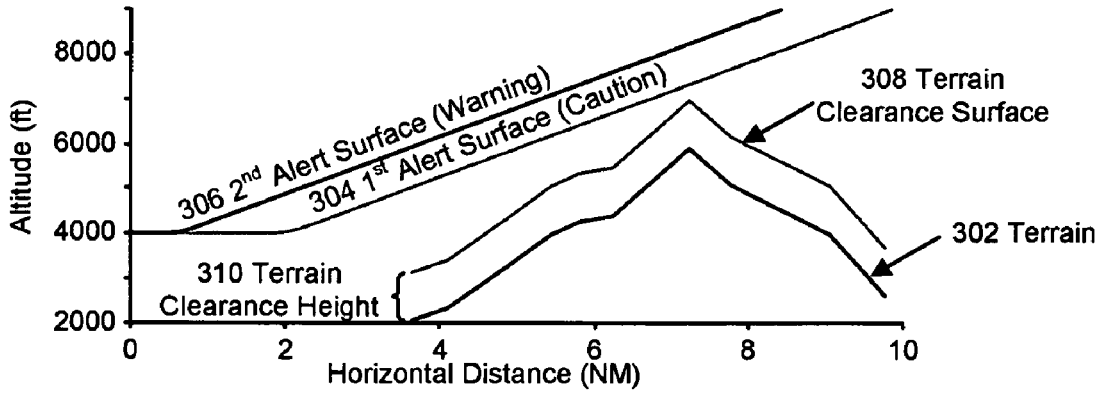
FIG. 9 provides exemplary depictions of vertical terrain alert surfaces of an aircraft in level flight.
Figure 9B:
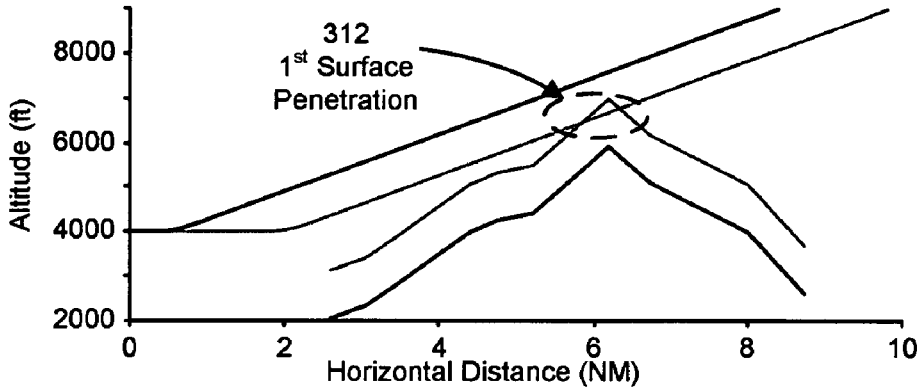
Figure 9C:
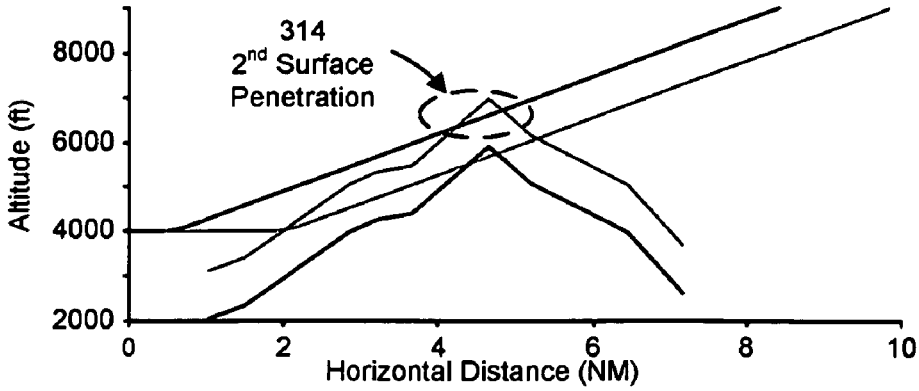

FIGS. 9A through 9C provide exemplary projections of two alerting surfaces of an aircraft operating at 4,000 feet in level flight and 500 knots which could be represented by such input factors as altitude 114, attitude 116, and speed 118. For the sake of comparison and brevity only, the exemplary projections of the airspace alert surfaces previously discussed in FIGS. 4D through 4F, FIGS. 6A through 6C, 7C through 7E, and FIGS. 8B through 8D, will be used as terrain alert surfaces in FIGS. 9A through 9C, FIGS. 10A through 10C, FIGS. 11A through 11C, and FIGS. 12A through 12C, respectively. As embodied herein, a manufacturer or end-user has the ability to define each and every airspace and terrain alert surface, and may or may not decide to use the same surface for both airspace and terrain applications. It should be noted that the use of the same alert surfaces for the sole purpose of illustrating both airspace and terrain avoidance applications in no way, shape, or form constitutes any limitation to the embodiments herein.

As shown in FIGS. 9A through 9C, the aircraft is approaching a hilly or mountainous terrain 302 of higher altitude along its projected flight path. As embodied herein, only one alerting surface may be sufficient for a generation of an alert signal by an AA processor 190 and for the receiving of such signal by a crew alerting system 195. A first alert surface 304 is based upon maneuver profile 210 (as was first alert surface 218), and a second alert surface 306 is based upon maneuver profile 204 (as was second alert surface 220). As shown in FIG. 9A, a first alert surface 304 could be associated with a caution-type alert, and as discussed above, a caution alert may require immediate crew awareness and subsequent corrective action. Likewise, a second alert surface 306 could be associated with a warning-type alert, and as discussed above, a warning alert may require immediate crew awareness and immediate crew action.

Terrain 302 of FIGS. 9A through 9C (which may include terrain, obstacles, or both as discussed herein) comprises of a surface representative of the elevation corresponding to the Earth's surface that could be provided by a terrain data source 140. In an embodiment herein, terrain data could be provided by a terrain database 142. In another embodiment, terrain data could be provided by a radar system 144. In another embodiment, terrain data could be provided by both terrain database 142 and radar system 144.

FIGS. 9A through 9C provide an exemplary depiction of a terrain clearance surface 308 that may be projected vertically above terrain 302 at a terrain clearance distance 310. Although not depicted, a terrain clearance surface could also be projected horizontally at a clearance distance to provide horizontal separation. As embodied herein, a terrain clearance distance 310 is optional and does not have to be employed. If not employed, a terrain clearance surface 308 could be considered the same as the terrain surface 302 or coinciding with the terrain surface 302, and receipt of terrain data could constitute the receipt of data representative of a terrain clearance surface 308. For example, a manufacturer or end-user could rely only on a maneuver profile(s) profiles that define an alert surface(s) to provide clearance. In another example, a terrain database 142 may include data representative of one or more terrain clearance surfaces, and the data provided could be based upon at least one input factor data 150. In such an example, a manufacturer or end-user could have terrain clearance surfaces corresponding to specific phases of flight, flight attitudes, or both as discussed below.

If employed, however, the value of a terrain clearance distance 310 may not remain constant between take-off and landing. As discussed above in detail in the context of airspace avoidance, the value of terrain clearance distance 310 could depend on the different phases of flight, flight attitudes, or both for terrain avoidance. As discussed herein, terrain clearance distances are illustrations intended solely to provide examples and are in no way intended to be limited to those discussed and presented herein. As embodied herein, an AA processor 190 may determine phase of flight, flight attitude, and terrain clearance distances data using algorithms programmed in executable software code. Those skilled in the art will appreciate the ability and ease with which executable software code may be reprogrammed or modified by a manufacturer or end-user to facilitate specific performance standards without affecting or expanding the scope of the embodiments discussed herein.

FIGS. 9B and 9C provide exemplary depictions of events in which a terrain clearance surface 308 penetrates two alert surfaces as the aircraft approaches terrain 302, where each event triggers an alert being that may be provided to the pilot by a crew alerting system 195. In an embodiment of FIG. 9B, a first surface penetration 312 has occurred where the terrain clearance surface 308 has penetrated a first alert surface 304 as the aircraft approaches terrain 302. Because the first alert surface 304 is associated with a caution alert in this example as discussed above, an AA processor 190 could generate a caution alert signal and provide such signal to a crew alerting system 195 as a result of the penetration. As the aircraft continues to approach terrain 302 as shown in FIG. 9C, a second surface penetration 314 has occurred where the terrain clearance surface 308 has penetrated a second alert surface 306. Because the second alert surface 306 is associated with a warning signal as discussed above, an AA processor 190 could generate a warning signal and provide such signal to the crew alerting system 195 as a result of the penetration.

As discussed above, a first alert surface 304 and a second alert surface 306 have been based upon maneuver profiles 210 and 204, respectively, where each has been based on maneuver profile 202 of a constant angle climb (e.g., six degrees) having a distance of 10 NM. As embodied herein and discussed above, however, the advantages of the embodiments herein may incorporate any profile which may be used or defined as a maneuver profile. A manufacturer or end-user of a TAWS 100 could establish or configure a plurality of maneuver profiles; on the other hand, a manufacturer or end-user of the aircraft may wish to provide a single maneuver profile under all conditions to simplify pilot training. As embodied herein, a maneuver profile may comprise of one or more vertical maneuvers, one or more horizontal maneuvers as discussed below in detail, or it may be a combination of one or more vertical and horizontal maneuvers.

Figure 10A:
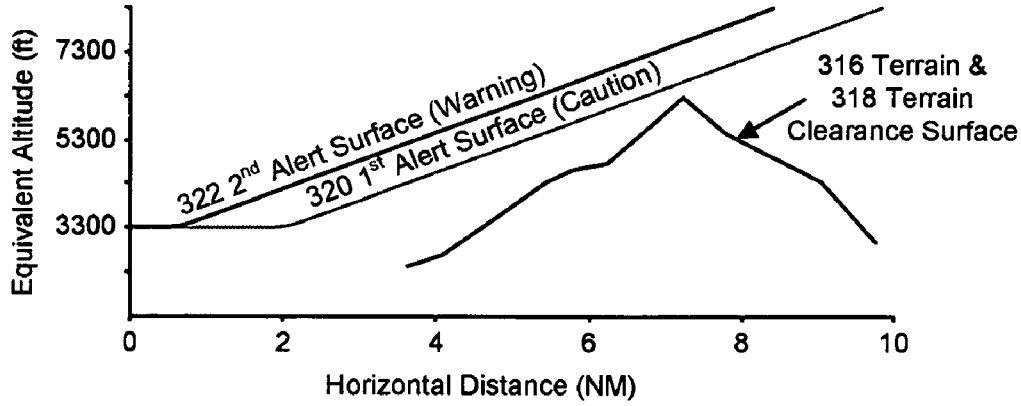
FIG. 10 provides exemplary depictions of vertical terrain alert surfaces of an aircraft in level flight where the terrain and terrain clearance surfaces coincide.
Figure 10B:
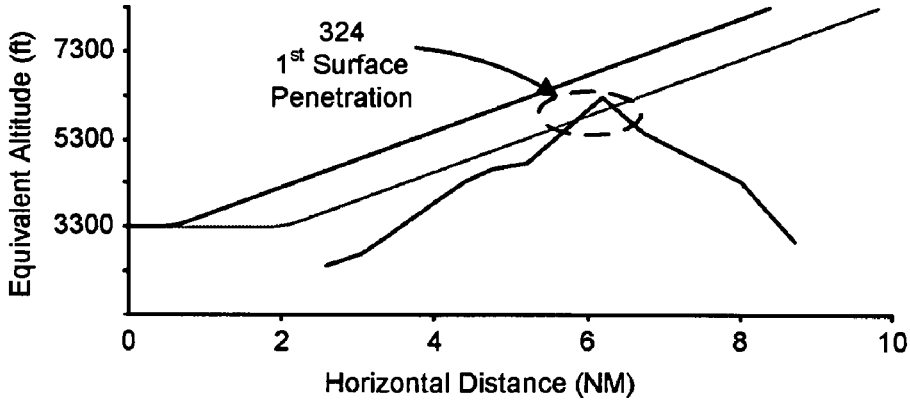
Figure 10C:
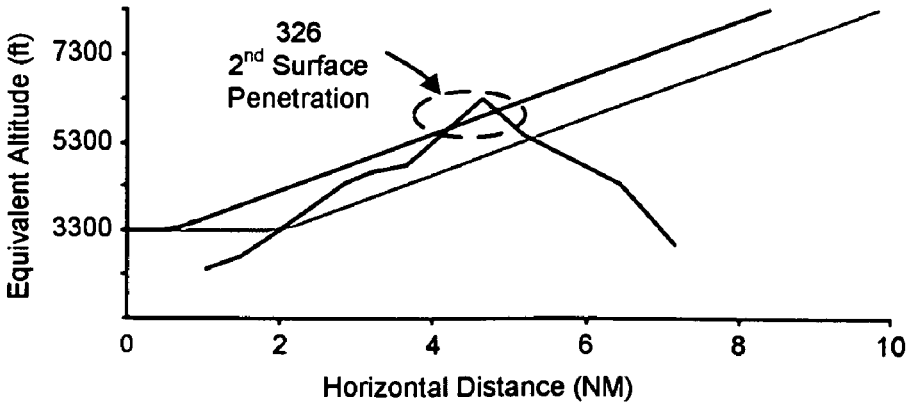

FIGS. 10A through 10C provide exemplary projections of two alert surfaces based upon the two maneuver profiles 204 and 210 of FIGS. 4B and 4C. In the embodiments of FIGS. 10A through 10C, terrain 316 and terrain clearance surface 318 coincide as depicted in FIG. 10A, which is an advantage of this embodiment because a terrain clearance distance 310 (e.g., FIG. 9A) may be omitted from the computation of an airspace clearance surface. In those embodiments where terrain and terrain clearance surface coincide, these terms may be used interchangeably. One exemplary manner to take advantage of this embodiment is to project each alert surface from an equivalent altitude that is offset by the value of a vertical terrain clearance distance 310 while the alert surface remains based upon an input factor of an altitude 114. As previously stated, an aircraft operating in level flight in the enroute phase of flight may have a vertical terrain clearance distance of 700 feet. Because a vertical terrain clearance distance is also the value of the offset, alert surfaces may be projected from the aircraft altitude of 4,000 feet to an equivalent altitude of 3,300 feet for this exemplary 700 feet vertical terrain clearance distance as shown in FIGS. 10A through 10C.

FIGS. 10B and 10C provide exemplary depictions of events in which a terrain clearance surface 318 penetrates two alert surfaces as the aircraft approaches terrain 316, where each event triggers an alert that may be provided to the pilot by a crew alerting system 195. In an embodiment of FIG. 10B, a first surface penetration 324 has occurred where the terrain clearance surface 318 has penetrated a first alert surface 320 as the aircraft approaches terrain 316. Because the first alert surface 320 is associated with a caution alert in this example as discussed above, an AA processor 190 could generate a caution alert signal and provide such signal to a crew alerting system 195 as a result of the penetration. As the aircraft continues to approach terrain 316 as shown in FIG. 10C, a second surface penetration 326 has occurred where the terrain clearance surface 318 has penetrated a second alert surface 322. Because the second alert surface 322 is associated with a warning signal as discussed above, an AA processor 190 could generate a warning signal and provide such signal to the crew alerting system 195 as a result of the penetration. It should be noted that the embodiments of FIGS. 10A through 10C may be applied for any alert surface and is not limited to the alert surfaces, phase of flight, or flight attitude depicted therein.

Figure 11A:
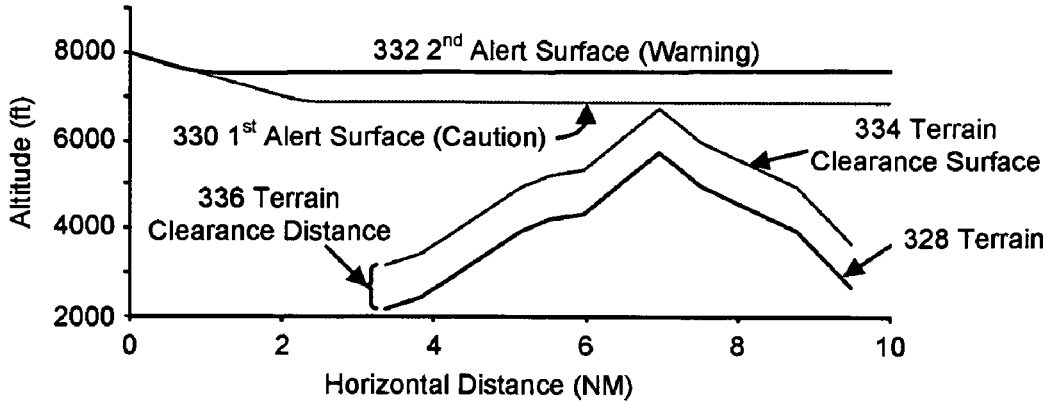
FIG. 11 provides exemplary depictions of vertical terrain alert surfaces of an aircraft in descending flight.
Figure 11B:
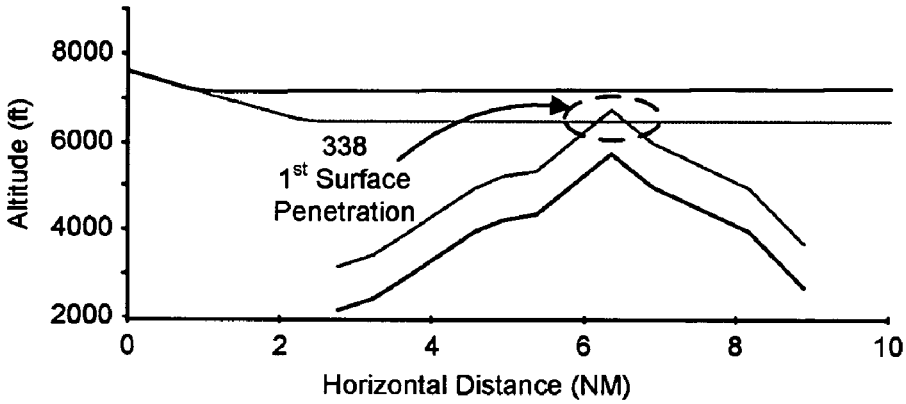
Figure 11C:
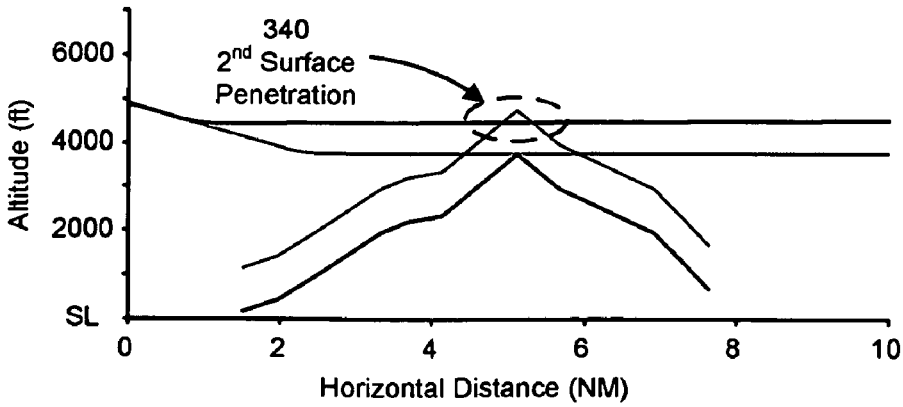

FIGS. 11A through 11C provide exemplary projections of two alerting surfaces of an aircraft descending through 6,000 feet which could be represented by input factors such as attitude 116 and altitude 114. As shown, the aircraft is approaching terrain 328 along its projected flight path. A first alert surface 330 is based upon maneuver profile 248, and a second alert surface 332 is based upon maneuver profile 242. As shown in FIG. 11A, a first alert surface 330 could be associated with a caution-type alert, and a second alert surface 332 could be associated with a warning-type alert.

FIGS. 11A through 11C depict of a terrain clearance surface 334 that may be projected above terrain 328 at a terrain clearance distance 336. FIGS. 11B and 11C provide exemplary depictions of events in which a terrain clearance surface 334 penetrates two alert surfaces as the aircraft approaches terrain 328, where each event triggers an alert being that may be provided to the pilot by a crew alerting system 195. In an embodiment of FIG. 11B, a first surface penetration 338 has occurred where the terrain clearance surface 334 has penetrated a first alert surface 330 as the aircraft approaches terrain 328. Because the first alert surface 330 is associated with a caution alert in this example as discussed above, an AA processor 190 could generate a caution alert signal and provide such signal to a crew alerting system 195 as a result of the penetration. As the aircraft continues to approach terrain 328 as shown in FIG. 11C, a second surface penetration 340 has occurred where the terrain clearance surface 334 has penetrated a second alert surface 332. Because the second alert surface 332 is associated with a warning signal as discussed above, an AA processor 190 could generate a warning signal and provide such signal to the crew alerting system 195 as a result of the penetration.

Figure 12A:
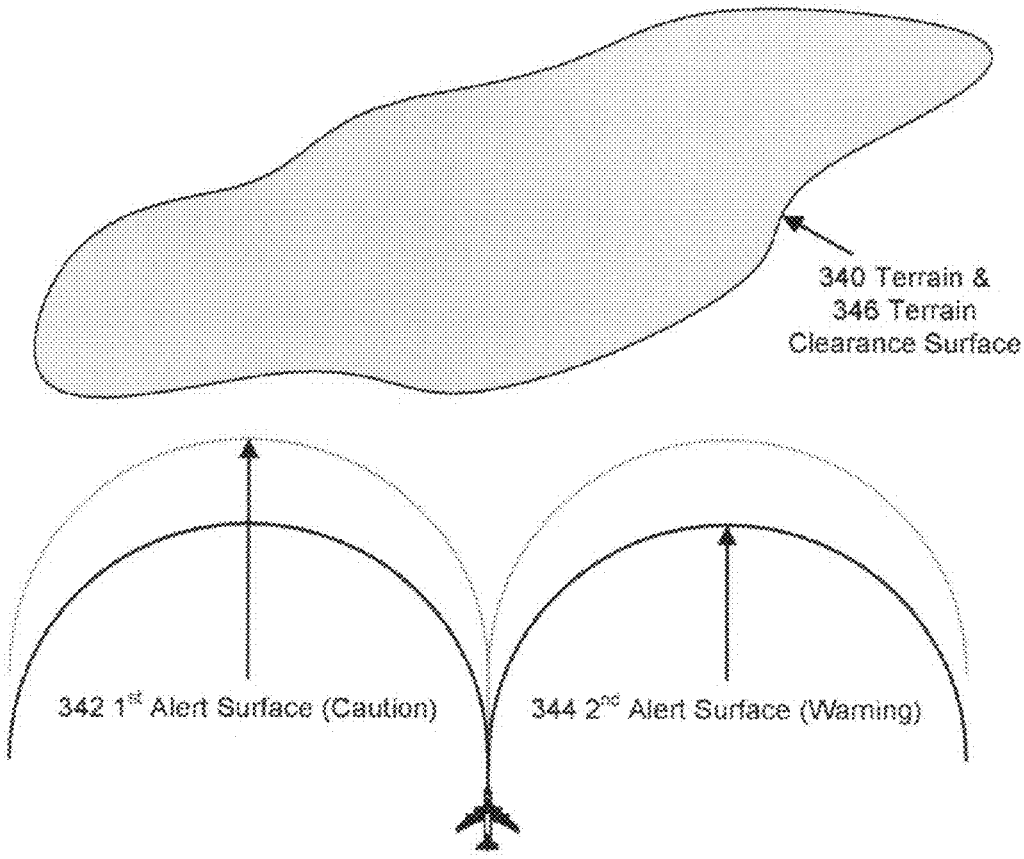
FIG. 12 provides exemplary depictions of horizontal terrain maneuver alert surfaces of an aircraft in flight.
Figure 12B:
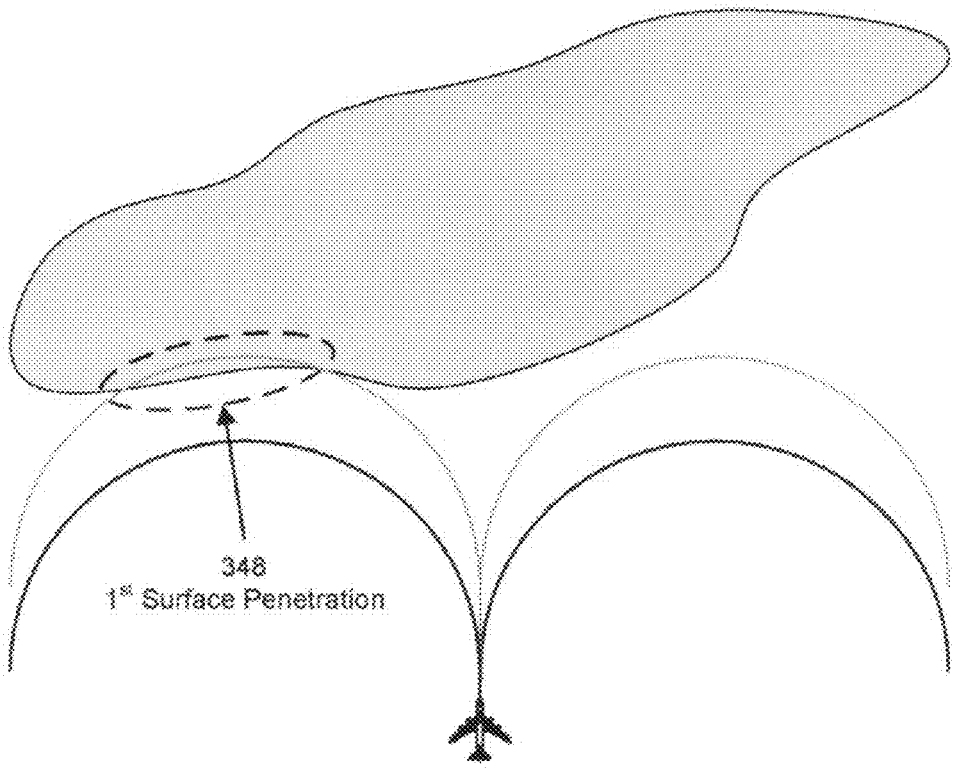
Figure 12C:
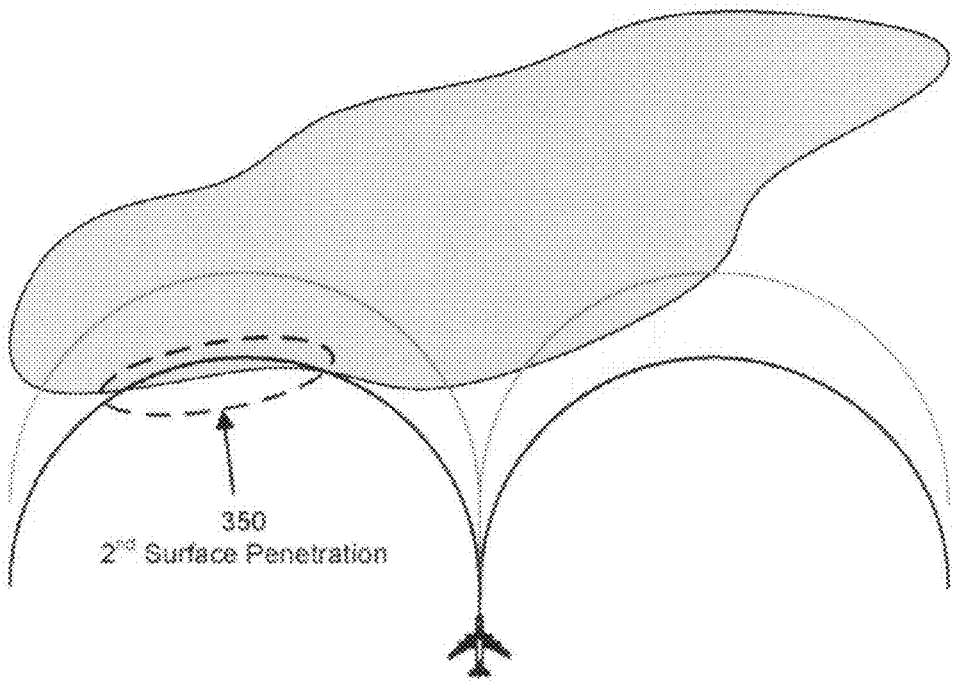

FIGS. 12A through 12C provide an exemplary depiction of an aircraft having two alerting surfaces based upon maneuver profiles 268 and 272 and approaching terrain 340 along its projected flight path. A first alert surface 342 is based upon maneuver profile 272, and a second alert surface 344 is based upon maneuver profile 268. As shown in FIG. 12A, a first alert surface 342 could be associated with a caution-type alert, and a second alert surface 344 could be associated with a warning-type alert.

FIGS. 12A through 12C depict a terrain clearance surface 346 that may be projected above terrain 340 at a terrain clearance distance (e.g., items 310 and 336). When viewed from above, the terrain clearance surface 346 coincides with terrain 340. FIGS. 12B and 12C provide exemplary depictions of events in which a terrain clearance surface 346 penetrates two alert surfaces as the aircraft approaches terrain 340, where each event triggers an alert that may be provided to the pilot by a crew alerting system 195. In an embodiment of FIG. 12B, a first surface penetration 348 has occurred where the terrain clearance surface 346 has penetrated a first alert surface 342 as the aircraft approaches terrain 340. Because the first alert surface 342 is associated with a caution alert in this example as discussed above, an AA processor 190 could generate a caution alert signal and provide such signal to a crew alerting system 195 as a result of the penetration. As the aircraft continues to approach terrain 340 as shown in FIG. 12C, a second surface penetration 350 has occurred where the terrain clearance surface 346 has penetrated a second alert surface 344. Because the second alert surface 344 is associated with a warning signal as discussed above, an AA processor 190 could generate a warning signal and provide such signal to the crew alerting system 195 as a result of the penetration.

It should be noted that the discussion thus far for both airspace and terrain avoidance has focused on separate vertical and horizontal profiles. Although the discussion has focused separately on maneuver profiles projected vertically and horizontally, an additional embodiment herein could provide a three-dimensional maneuver profile that may combine or incorporate both horizontal and vertical profiles, either in part or in whole. Because an alerting surface may be based upon a maneuver profile, a three-dimensional alerting surface may be based upon a three-dimensional maneuver profile.

Figure 13:
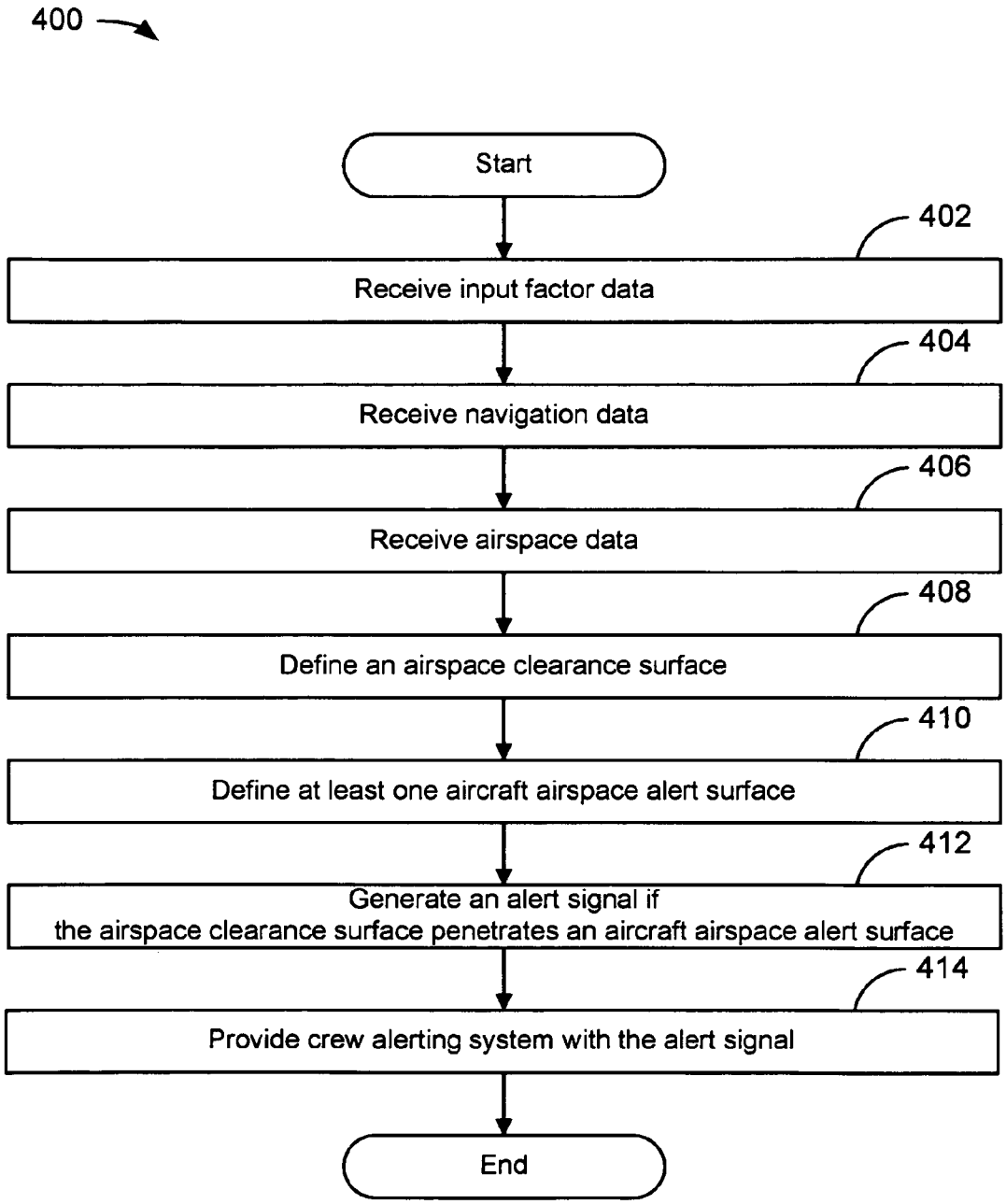
FIG. 13 provides a flowchart illustrating a method for generating an alert signal in an airspace awareness and warning system FIG. 14 provides a flowchart illustrating a second method for generating an alert signal in an airspace awareness and warning system

FIG. 13 depicts a flowchart 400 of an example of a method for generating an alert signal in an AAWS 100. The flowchart begins with module 402 with receiving of input factor data. Input factor data could comprise of data representative of at least one input factor. Examples of input factors 150 include, but are not limited to, input from a navigation system 110, an airport database 130, an airspace database 135, and a terrain database 142. The flowchart continues with module 404 with receiving of aircraft position from a navigation system 110. The flowchart continues with module 406 with retrieving or receiving airspace data corresponding to the aircraft position from an airspace data source such as an airspace database 135.

The flowchart continues with module 408 with defining an airspace clearance surface. In one embodiment, an airspace clearance surface may be defined by an AA processor 190 as a function of the airspace data and at least one airspace clearance distance criterion. In an embodiment, at least one airspace clearance distance criterion could be programmed to include input factor data. For example, airspace clearance distance criteria could include data representative of phase of flight and flight attitude, and these criteria could be programmed to include input factors 150 of, but not limited to, geographic position 112, altitude 114, attitude 116, speed 118, vertical speed 120, and input from an airport database 130. As a result, an airspace clearance surface could be projected vertically above an airspace surface terrain at a distance of an airspace clearance distance after the application of at least one real-time or static input factor 150 to provide vertical separation. In another embodiment, an airspace clearance surface could also be projected horizontally at a clearance distance to provide horizontal separation.

The flowchart continues with module 410 with defining of at least one aircraft airspace alert surface. At least one aircraft airspace alert surface could be defined by an AA processor 190 as a function of at least one criterion that has been programmed to include input factor data. Each aircraft airspace alert surface could be based upon at least one criterion programmed to include input factor data. For example, the aircraft airspace alert surface may include pilot reaction time and G-force maneuver as criteria, and these criteria could be programmed to include an input factor 150 of speed 118 as input factor data. As a result, an aircraft airspace alert surface could be projected in front of the aircraft after the application of at least one real-time input factor 150. As embodied herein, an aircraft airspace maneuver profile—and associated airspace alert surface—may be a vertical profile, horizontal profile, or a combination of both.

The flowchart continues with module 412 with generating an airspace alert signal if the airspace clearance service penetrates the aircraft airspace alert surface. The flowchart continues with module 414 with providing the airspace alert signal to a crew alerting system 160. In one embodiment, the alert signal could cause a presentation of a caution or warning alert on a display, an aural alert by the aural alert unit, or both. Then, the flowchart proceeds to the end.

Figure 14:
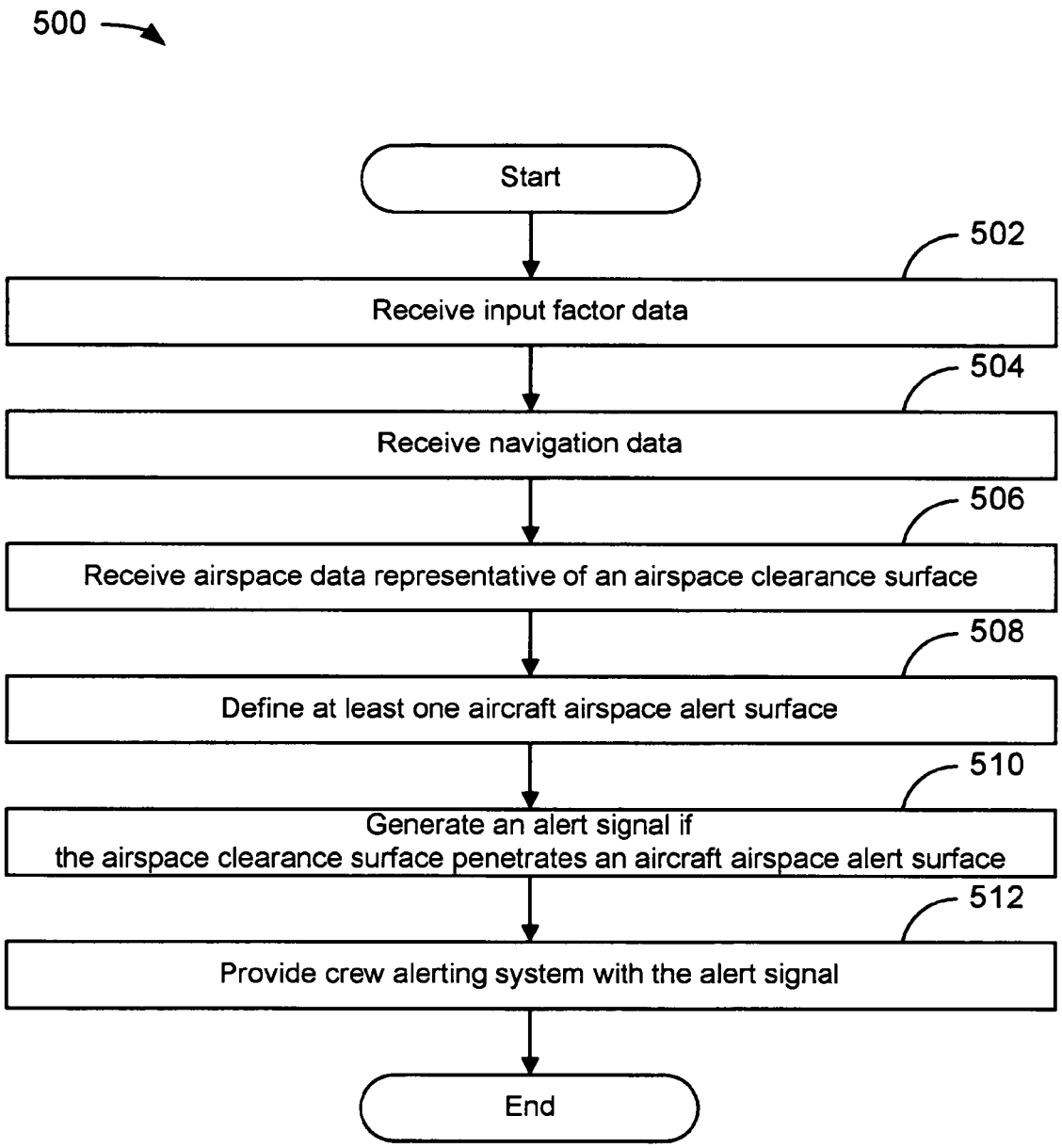

FIG. 14 depicts a flowchart 500 of an example of a second method for generating an alert signal in an AAWS. The flowchart begins with module 502 with receiving of input factor data. Input factor data could comprise of data representative of at least one input factor. As embodied herein, input factors 150 could be provided by any aircraft system, sensor, or database including, but not limited to, a navigation system 110, and airport-related database 130, and airspace database 135. The flowchart continues with module 504 with receiving of aircraft position from a navigation system 110. The flowchart continues with module 506 with retrieving or receiving airspace data corresponding to the aircraft position from an airspace data source such as an airspace database 135. The airspace data could be representative of an airspace clearance surface.

The flowchart continues with module 508 with defining of at least one aircraft airspace alert surface. At least one aircraft airspace alert surface could be defined by an AA processor 190 as a function of at least one criterion that has been programmed to include input factor data and at least one airspace clearance distance criteria. Each aircraft airspace alert surface could be based upon at least one criterion programmed to include input factor data. For example, the aircraft airspace alert surface may include pilot reaction time and G-force maneuver as criteria, and these criteria could be programmed to include an input factor 150 of speed 118 as input factor data. As a result, an aircraft airspace alert surface could be projected in front of the aircraft after the application of at least one input, factor 150. As embodied herein, an aircraft airspace maneuver profile—and associated airspace alert surface—may be a vertical profile, horizontal profile, or a combination of both.

At least one airspace clearance distance criterion, for example, could include data representative of phase of flight and flight attitude, and these criteria could be programmed to include input factors 150 of, but not limited to, geographic position 112, altitude 114, attitude 116, speed 118, vertical speed 120, and input from an airport database 130. Such criterion could be included in the function or by adding it as a second function. As a result, an airspace alert surface could be projected below the altitude of the aircraft at a distance of the airspace clearance distance after the application of the input factors 150.

The flowchart continues with module 510 with generating an airspace alert signal if the airspace clearance service penetrates the aircraft airspace alert surface. The flowchart continues with module 512 with providing the airspace alert signal to a crew alerting system 160. In one embodiment, the alert signal could cause a presentation of a caution or warning alert on a display, an aural alert by the aural alert unit, or both. Then, the flowchart proceeds to the end.

It should be noted that the method steps described above are embodied in computer-readable media as computer instruction code. It shall be appreciated to those skilled in the art that not all method steps must be performed, nor must they be performed in the order stated. As embodied herein, the actions that could be performed by an AA processor 190 are includes as method steps.

As used herein, the term "embodiment" means an embodiment that serves to illustrate by way of example but not limitation.

It will be appreciated to those skilled in the art that the preceding examples and embodiments are exemplary and not limiting to the scope of the present invention. It is intended that all permutations, enhancements, equivalents, and improvements thereto that are apparent to those skilled in the art upon a reading of the specification and a study of the drawings are included within the true spirit and scope of the present invention. It is therefore intended that the following appended claims include all such modifications, permutations and equivalents as fall within the true spirit and scope of the present invention.

What is claimed is:

1. A system for generating an alert signal in an aircraft system, said system comprising: a data source for providing input factor data;

a data source for providing airspace data;

a data source for providing navigation data;

an alert processor, electronically coupled to receive data from a data source, wherein such processor receives input factor data, wherein input factor data comprises data representative of at least one input factor;

receives navigation data representative of aircraft position, receives airspace data corresponding to the aircraft position, defines an airspace clearance surface as a function of the airspace data and at least one airspace clearance distance criterion, defines at least one aircraft airspace alert surface, where each aircraft airspace alert surface is defined as a function of at least one criterion programmed to include first input factor data, wherein the airspace data is received from a database storing data as a function of at least one second input factor data, wherein the function defining each airspace alert surface includes at least one airspace clearance distance criterion is programmed to include a third input factor data, generates an airspace alert signal if the airspace clearance surface penetrates an aircraft airspace alert surface, and provides the airspace alert signal to a crew alerting system; and a crew alerting system, electronically coupled to receive an alert signal, for receiving the airspace alert signal.

2. The system of claim 1, wherein the data source for providing input factor data comprises one or more of the following: a navigation system, an airport-related database, an airspace database, and a terrain data source.

3. The system of claim 2, wherein the data source for providing terrain data comprises of a radar system, a terrain database, or both, where the terrain data provided by a terrain database corresponds to data representative of aircraft position received from a data source of navigation data.

4. The system of claim 1, wherein the crew alerting system comprises one or more of the following: a display unit, an aural alert unit, and a tactile unit.

5. A system for generating an alert signal in an aircraft system, said system comprising:

a data source for providing input factor data;

a data source for providing airspace data;

a data source for providing navigation data;

an alert processor, electronically coupled to receive data from a data source, wherein such processor receives input factor data, wherein input factor data comprises data representative of at least one input factor;

receives navigation data representative of aircraft position, receives airspace data corresponding to the aircraft position, where such airspace data is representative of an airspace clearance surface, defines at least one aircraft airspace alert surface, where each aircraft airspace alert surface is defined as a function of at least one criterion programmed to include first input factor data, wherein the airspace data is received from a database storing data as a function of at least one second input factor data, wherein the function defining each airspace alert surface includes at least one airspace clearance distance criterion is programmed to include a third input factor data, generates an airspace alert signal if the airspace clearance surface penetrates an aircraft airspace alert surface; provides the airspace alert signal to a crew alerting system; and the crew alerting system for receiving the airspace alert signal.

6. The system of claim 5, wherein the data source for providing input factor data comprises one or more of the following: a navigation system, an airport-related database, an airspace database, and a terrain data source.

7. The system of claim 6, wherein the data source for providing terrain data comprises of a radar system, a terrain database, or both, where the terrain data provided by a terrain database corresponds to data representative of aircraft position received from a data source of navigation data.

8. The system of claim 5, wherein the airspace data defines an airspace surface.

9. The system of claim 5, wherein each airspace alert surface is further defined by a second function having at least one airspace clearance distance criterion programmed to include third input factor data.

10. The system of claim 5, wherein the crew alerting system comprises one or more of the following: a display unit, an aural alert unit, and a tactile unit.

11. A method for generating an alert signal in an aircraft system using a processor, said method comprising: receiving input factor data, wherein input factor data comprises data representative of at least one input factor;

receiving navigation data representative of aircraft position;

receiving airspace data corresponding to the aircraft position;

defining an airspace clearance surface as a function of the airspace data and at least one airspace clearance distance criterion;

wherein at least one airspace clearance distance criterion is programmed to include second input factor data;

defining at least one aircraft airspace alert surface, where each aircraft airspace alert surface is defined as a function of at least one criterion, wherein at least one criterion is programmed to include third input factor data;

generating an airspace alert signal if the airspace clearance surface penetrates an aircraft airspace alert surface; and providing the airspace alert signal to a crew alerting system.

12. A method for generating an alert signal in an aircraft system using a processor, said method comprising: receiving input factor data, wherein input factor data comprises data representative of at least one input factor;

receiving navigation data representative of aircraft position;

receiving airspace data corresponding to the aircraft position, where such airspace data is representative of an airspace clearance surface;

defining at least one aircraft airspace alert surface, where each aircraft airspace alert surface is defined as a function of at least one criterion, wherein at least one criterion is programmed to include first input factor data;

wherein the airspace data is received from a database storing data as a function of at least one second input factor data;

wherein the function defining each airspace alert surface includes at least one airspace clearance distance criterion programmed to include third input factor data;

generating an airspace alert signal if the airspace clearance surface penetrates an aircraft airspace alert surface; and providing the airspace alert signal to a crew alerting system.

13. The method of claim 12, wherein the airspace data defines an airspace surface.

14. The method of claim 12, wherein each airspace alert surface is further defined by a second function having at least one airspace clearance distance criterion programmed to include third input factor data.

* * * * *